US010023418B2

(12) United States Patent
Asai et al.

(10) Patent No.: US 10,023,418 B2
(45) Date of Patent: Jul. 17, 2018

(54) RECEPTION APPARATUS

(71) Applicant: CANON KABUSHIKI KAISHA, Tokyo (JP)

(72) Inventors: Yasuyuki Asai, Tokyo (JP); Hiromasa Yoneyama, Chigasaki (JP); Daiki Anayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/262,484

(22) Filed: Sep. 12, 2016

(65) Prior Publication Data

US 2017/0088384 A1 Mar. 30, 2017

(30) Foreign Application Priority Data

Sep. 29, 2015 (JP) ..... 2015-191223
Sep. 29, 2015 (JP) ..... 2015-191277
Sep. 29, 2015 (JP) ..... 2015-191317

(51) Int. Cl.

| | |
|---|---|
| ***B65H 31/04*** | (2006.01) |
| ***B41J 15/04*** | (2006.01) |
| ***B41J 13/10*** | (2006.01) |
| ***B65H 16/00*** | (2006.01) |
| ***B65H 31/02*** | (2006.01) |
| ***B65H 31/20*** | (2006.01) |

(52) U.S. Cl.
CPC ..... *B65H 31/04* (2013.01); *B41J 13/106* (2013.01); *B41J 15/04* (2013.01); *B65H 16/005* (2013.01);
(Continued)

(58) Field of Classification Search
CPC ..... B65H 31/04; B65H 31/02; B65H 31/22; B65H 35/0006; B65H 2801/36;
(Continued)

(56) References Cited

U.S. PATENT DOCUMENTS 5,188,352 A * 2/1993 Bartman ..... B65H 31/02 271/175
6,568,865 B1 * 5/2003 Fujioka ..... B65H 31/02 271/207

(Continued)

FOREIGN PATENT DOCUMENTS

| | | |
|---|---|---|
| EP | 1 095 889 A1 | 5/2001 |
| JP | 2006-036368 A | 2/2006 |
| JP | 2009-242111 A | 10/2009 |

OTHER PUBLICATIONS

European Search Report dated Mar. 3, 2017, in related European Patent Application No. 16001821.4.
U.S. Appl. No. 15/262,459, filed Sep. 12, 2016.

*Primary Examiner* — Patrick Cicchino
(74) *Attorney, Agent, or Firm* — Fitzpatrick, Cella, Harper & Scinto

(57) ABSTRACT

A reception apparatus that receives an article discharged from a processing apparatus includes a first rod, second rod and a reception sheet. The first rod extends in a direction crossing a direction of the discharge below a discharge port of the processing apparatus in a gravity direction. The second rod extends in the direction crossing the direction of the discharge at a position farther away from the discharge port than the first rod. The reception sheet has flexibility, is supported by the first rod and the second rod, and receives the article discharged between the first rod and the second rod. The first rod is capable of being disposed at a first position and a second position which are different from each other in the gravity direction.

25 Claims, 24 Drawing Sheets

(52) U.S. Cl.
CPC ..... *B65H 31/02* (2013.01); *B65H 31/20* (2013.01); *B65H 2401/14* (2013.01); *B65H 2405/1116* (2013.01); *B65H 2701/11312* (2013.01); *B65H 2801/36* (2013.01)

(58) Field of Classification Search
CPC ..... B65H 2701/11312; B65H 2301/16; B41J 13/106; B41J 15/04
See application file for complete search history.

(56) References Cited

U.S. PATENT DOCUMENTS 7,997,578 B2 * 8/2011 Saito ..... B65H 31/02 271/207
8,276,907 B2 * 10/2012 Shiohara ..... B41J 13/106 271/207
8,579,527 B2 * 11/2013 Onuki ..... B41J 3/4078 271/175
9,002,257 B2 * 4/2015 Saiga ..... B41J 11/70 399/405
9,181,060 B2 * 11/2015 Horie ..... B41J 11/001
9,327,529 B2 * 5/2016 Kato ..... B41J 13/0009
2002/0054183 A1 * 5/2002 Kanaya ..... B41J 2/16526 347/23
2013/0286125 A1 * 10/2013 Mikuriya ..... B41J 13/106 347/104
2014/0292980 A1 10/2014 Horie
2015/0273897 A1 * 10/2015 Kato ..... B41J 13/0009 347/104

* cited by examiner

RECEPTION APPARATUS

BACKGROUND OF THE INVENTION

Field of the Invention

The present invention relates to a reception apparatus receiving an article discharged from a processing apparatus such as a printer.

Description of the Related Art

Japanese Patent Laid-Open No. 2009-242111 discloses a configuration in which a position of a flexible sheet for receiving papers discharged from a printer is appropriately changed depending on a type and a size of the paper. Specifically, a size and a depth of a reception region of the large sheet can be adjusted by arranging a shaft mounted on a leading end or a middle portion of flexible large sheet at various positions, and winding the large sheet on the shaft.

However, in first and second rear discharge modes according to Japanese Patent Laid-Open No. 2009-242111, a distance in a gravity direction from a paper-discharging portion to a reception sheet receiving the paper is large. Therefore, in a case of a small-sized paper, there is a concern about damages associated with falling, and in a case of a paper having curling tendency, the paper can scratch a surface of another paper that has been already received. In a case of a front discharge mode, the generation of the damages during discharge can be suppressed, but there is a concern that the reception sheet cannot receive the paper having slid down on an inclined portion. In order to avoid this, role paper can be configured not to be automatically cut for each page, but this case will result in bothering a user due to manual cutting of the paper.

Furthermore, according to Japanese Patent Laid-Open No. 2009-242111, rotation of the shaft is not restricted. Therefore, in a case where a large number of papers are discharged and loaded onto the large sheet, or in a case where some external forces are applied to thereby generate a rotational force, there is a fear that a shape of the large sheet may be changed since winding of the large sheet is loosened or the number of winding times is reduced.

Moreover, in the configuration according to Japanese Patent Laid-Open No. 2009-242111, both in an inclined state and a horizontal state, a paper-discharging guide maintains a substantially flat and smooth surface. Accordingly, the paper discharged first is normally discharged and held, but in a case where the curled paper is continuously discharged, for example, the paper may move or slide down along the paper-discharging guide.

SUMMARY OF THE INVENTION

The present invention has been made in order to solve the above-described problems. Therefore, an object of the present invention is to provide a reception apparatus capable of reliably receiving papers (articles) having no damage without bothering a user, even in a situation where various sizes of sheets (articles) having curling are discharged.

According to a first aspect of the present invention, there is provided a reception apparatus that receives an article discharged from a processing apparatus, the reception apparatus comprising: a first rod extending in a direction crossing a direction of the discharge below a discharge port of the processing apparatus in a gravity direction; a second rod extending in the direction crossing the direction of the discharge at a position farther away from the discharge port than the first rod; and a reception sheet having flexibility, supported by the first rod and the second rod, and configured to receive the article discharged between the first rod and the second rod, wherein the first rod is capable of being disposed at a first position and a second position which are different from each other in the gravity direction and each provided on the processing apparatus.

According to a second aspect of the present invention, there is provided a reception apparatus that receives an article discharged from a processing apparatus, the reception apparatus comprising: a first rod extending in a direction crossing a direction of the discharge below a discharge port of the processing apparatus in a gravity direction; a second rod extending in the direction crossing the direction of the discharge at a position farther away from the discharge port than the first rod; a reception sheet having flexibility, supported by the first rod and the second rod, and configured to receive the article discharged between the first rod and the second rod, and an adjustment unit configured to change and fix a reception length of the reception sheet arranged between the first rod and the second rod.

Further features of the present invention will become apparent from the following description of exemplary embodiments (with reference to the attached drawings).

DESCRIPTION OF THE EMBODIMENTS

Figure 1A:
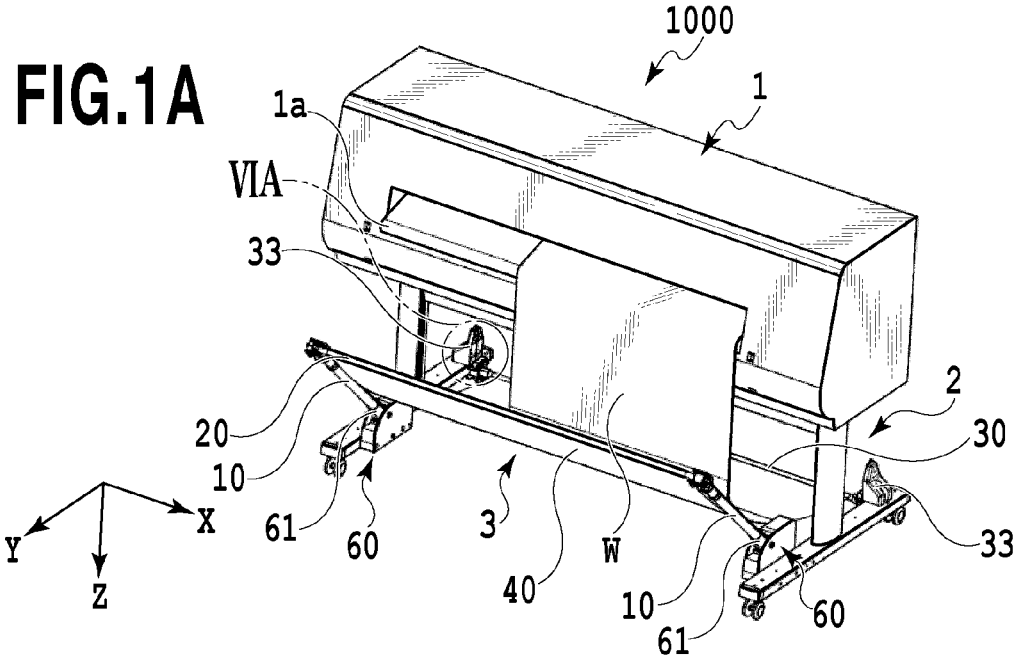
FIGS. 1A to 1C illustrate an external view of a print apparatus that can be used as a reception apparatus of the present invention.
Figure 1B:
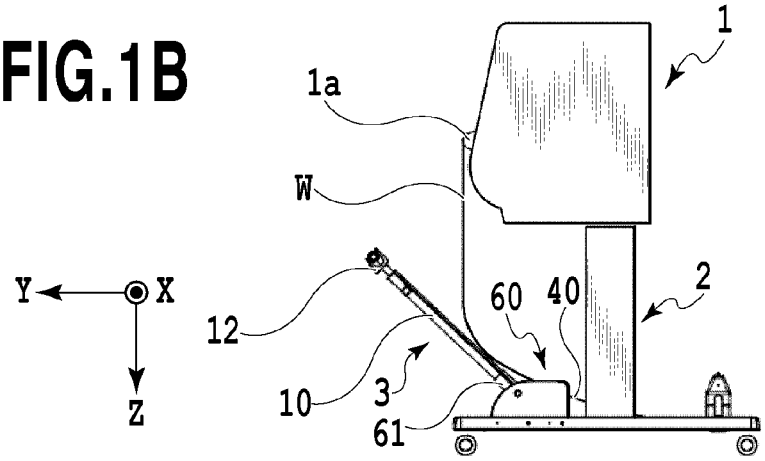
Figure 1C:
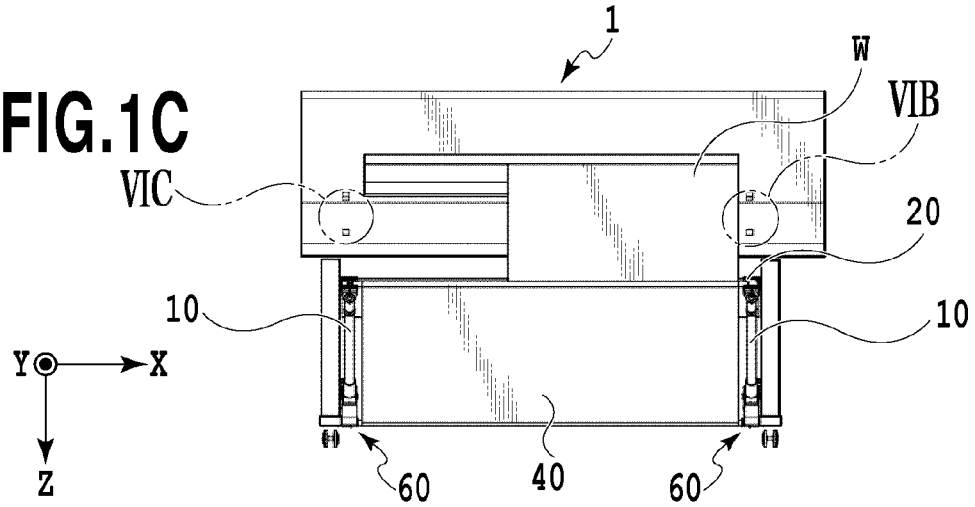

FIGS. 1A to 1C illustrate an external view of a print apparatus 1000 that can be used as a reception apparatus of the present invention. FIG. 1A is a perspective view of the print apparatus 1000, FIG. 1B is a side view thereof, and FIG. 1C is a front view thereof. The print apparatus 1000 mainly includes a printer unit 1, a leg unit 2 supporting the printer unit 1, and a reception unit 3 receiving a print medium discharged from a discharge port 1*a* of the printer unit 1.

The printer unit 1 includes a print medium W held in a rolled shape, a print head capable of printing an image on the print medium W, a cutter cutting the print medium W for each printed page, and the like. The print medium W including a region in which a predetermined image is printed by a print head is gradually discharged via the discharge port 1*a* along with the advance of a print operation, and hangs down from the discharge port 1*a* in a Z direction due to its own weight. Then, in a case where a cutter cuts a rear end portion of the image, the cut print medium W is received by the reception unit 3.

Hereinafter, the reception unit 3 that is a characteristic configuration of the present invention will be described in detail.

Figure 2:
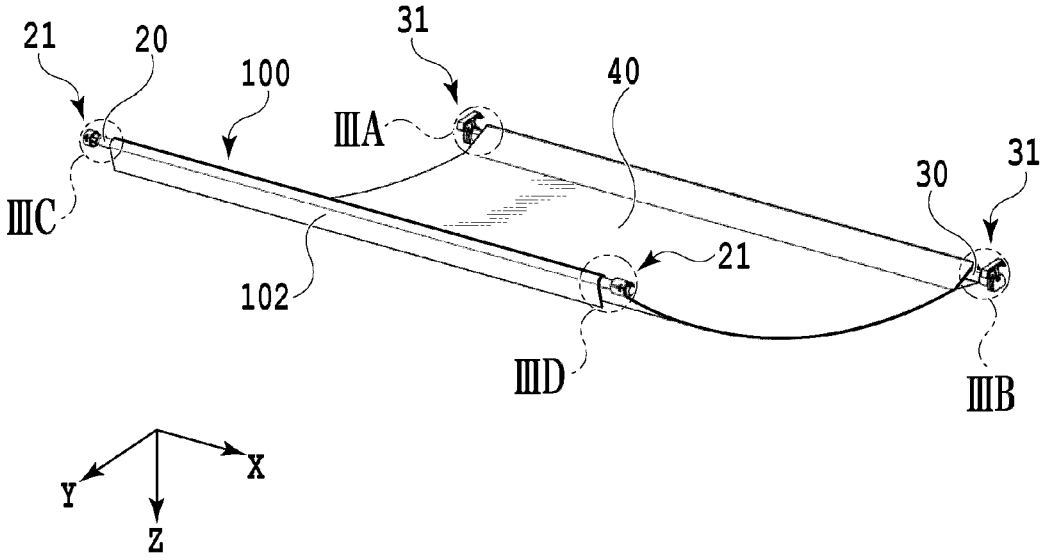
FIG. 2 is a schematic view of a sheet-holding configuration in which a print medium is received.

FIG. 2 is a schematic view of a sheet holding configuration 100 receiving the print medium W in the reception unit 3. Both ends of a flexible reception sheet 40 in a Y direction are supported by each of a top rod 20 and a rear rod 30 extending in an X direction. First engagement units 21 are mounted at both ends of the top rod 20 in the X direction, and second engagement units 31 are mounted at both ends of the rear rod 30 in the X direction. A position and posture of the entire sheet holding configuration 100 can be changed depending on the position of the print apparatus 1000 and whether the first engagement units 21 and the second engagement units 31 are respectively engaged with each other. Note that, as long as the reception sheet 40 is in the form of a thin and flexible sheet, the quality of the material of the reception sheet 40 is not particularly limited, and can adopt various types of forms such as a plastic sheet and a metal sheet in addition to cloth.

Figure 3A:
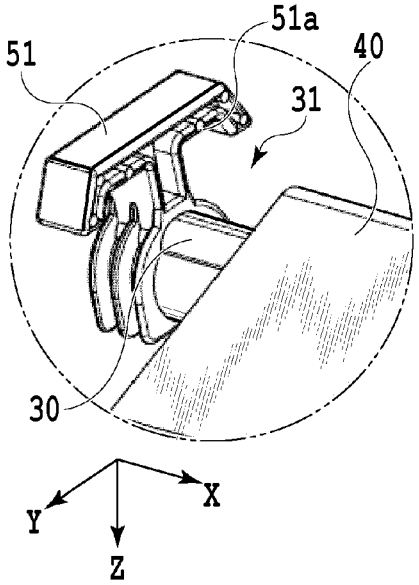
FIGS. 3A to 3D illustrate detail views of second engagement units and first engagement units.
Figure 3B:
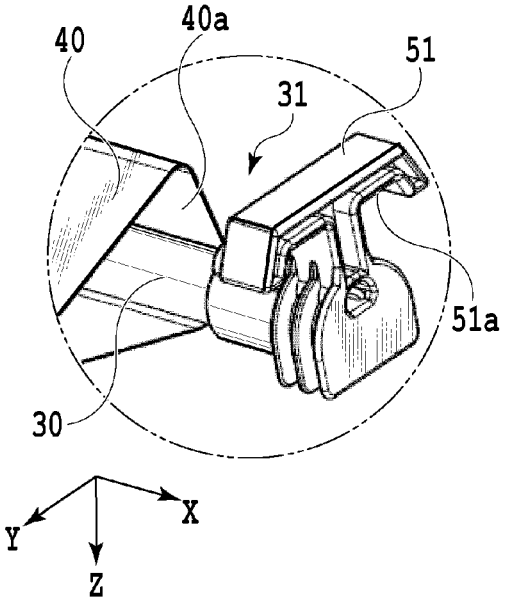

FIGS. 3A to 3D illustrate detail views of two second engagement units 31 arranged at both ends of the rear rod 30, and two first engagement units 21 arranged at both ends of the top rod 20. FIGS. 3A and 3B are enlarged views of regions surrounded using a broken line circles IIIA and IIIB in FIG. 2, and illustrate the second engagement unit 31 on a left side and the second engagement unit 31 on a right side in a case of being viewed from a front (in −Y direction). The rear rod 30 passes through a cylindrical shape 40*a* of the reception sheet 40, and a rear rod holding member 51 is arranged at both ends of the reception sheet 40. A hook 51*a* attached to the rear rod holding member 51 can be attached to a plurality of attachment portions arranged in the apparatus. The attachment portions will be described in detail below.

Figure 3C:
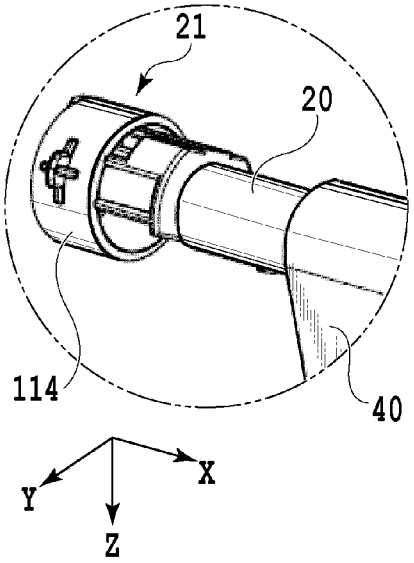
Figure 3D:
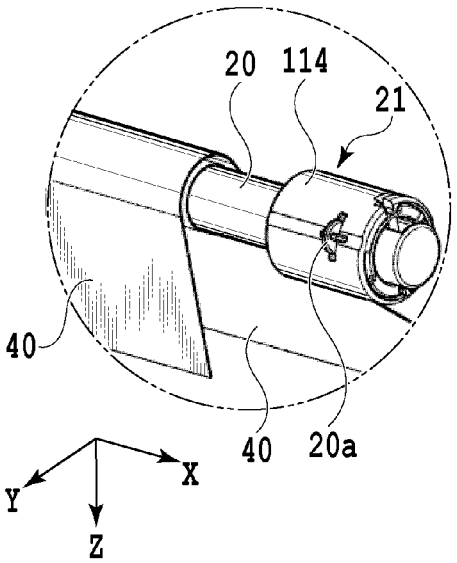

On the other hand, FIGS. 3C and 3D are enlarged views of regions surrounded using a broken line circles IIIC and IIID in FIG. 2, and illustrate the first engagement unit 21 on the left side and the first engagement unit 21 on the right side in a case of being viewed from the front (−Y direction). An end portion or a middle portion of the reception sheet 40 is fixed onto the top rod 20 so as to be wound. The first engagement unit 21 arranged at the both ends of the top rod 20 can be coupled with the side rod 10 capable of rotating about the print apparatus 1000.

FIGS. 1A to 1C will be referenced once again. The side rods 10 (supporting rods) are arranged at both sides of the print apparatus 1000 in the X direction, and can rotate in a YZ plane in a state where one of the end portions is supported by side rod angle holding units 60 fixed to a leg unit 2. Furthermore, a joint portion 12 to which the first engagement unit 21 of the top rod 20 can be engaged is arranged, at another end portion of the side rod 10.

Figure 4:
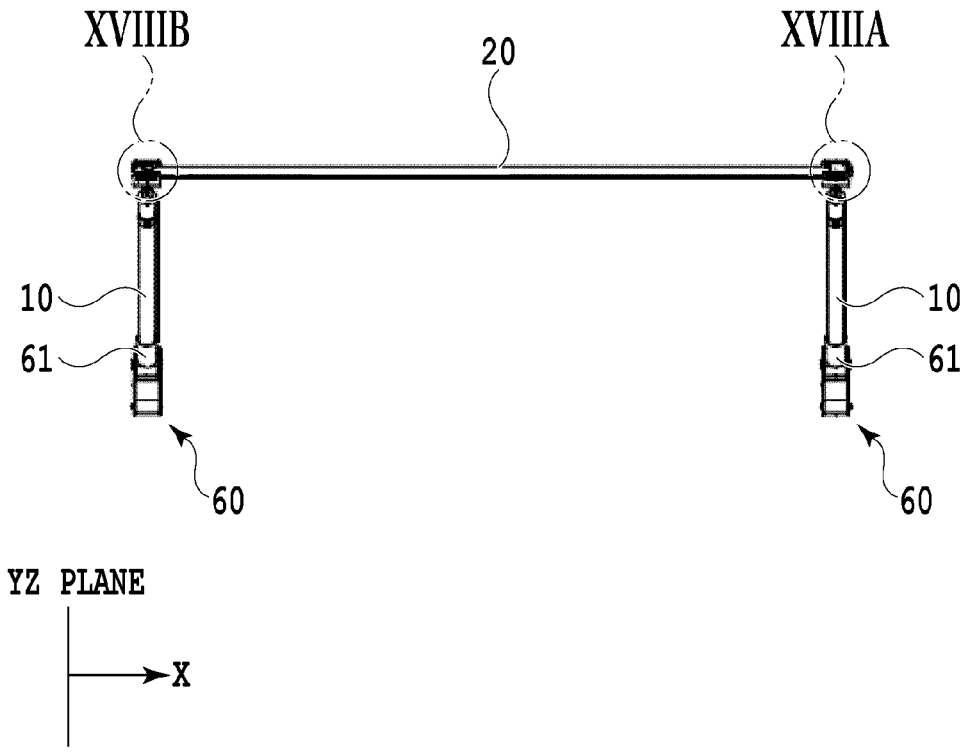
FIG. 4 is a top plan view illustrating a joining state between a top rod and a side rod.

FIG. 4 is a top plane view illustrating a joining state between the top rod 20 and the side rod 10. One side of the side rod 10 is connected to the side rod angle holding member 60 via a side rod support member 61, and another side thereof is joined to the first engagement unit 21 arranged at both ends of the top rod 20.

Figure 5A:
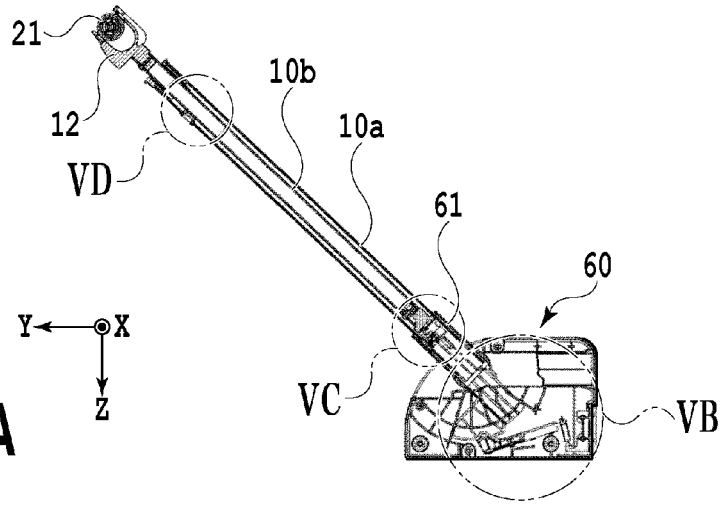
FIGS. 5A to 5D illustrate detail views of a side rod and a side rod angle holding member.
Figure 5B:
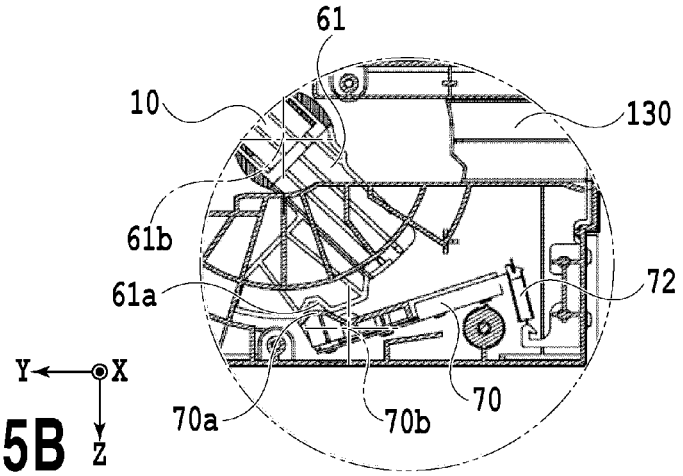
Figure 5C:
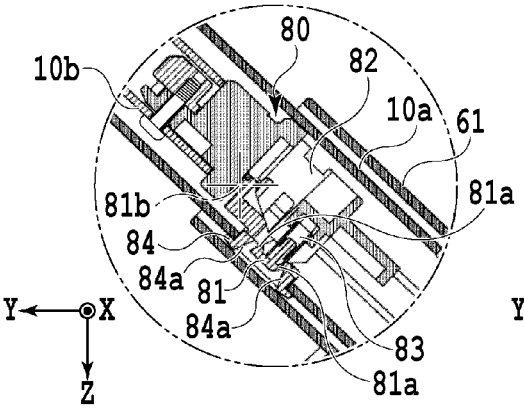
Figure 5D:
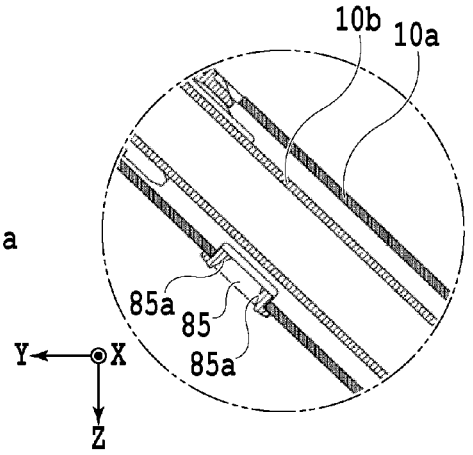

FIGS. 5A to 5D illustrate detail views of the side rod 10 and the side rod angle holding member 60. FIG. 5A is a cross-sectional view of the side rod 10 and the side rod angle holding member 60. FIGS. 5B to 5D are enlarged views of a region surrounded using broken line circles VB to VD in FIG. 5A.

With reference to FIG. 5A, the side rod 10 has a first side rod 10*a* that is hollow and has a second side rod 10*b* that is likewise hollow and is capable of being taken in/out from an inside of the first side rod 10*a* in an extension direction thereof. The first side rod 10*a* is joined with the side rod support member 61, and the second side rod 10*b* can be connected to the first engagement unit 21 of the top rod 20. The U-shaped joint portion 12 that can mount the top rod 20 is attached to the leading end of the second side rod 10*b*.

With reference to FIG. 5B, the side rod angle holding unit 60 has a base member 130 attached to the leg unit 2, a side rod support member 61 for rotating and supporting the side rod 10, and a rotation stop lever 70 for restricting rotation of the side rod support member 61. The side rod support member 61 is attached to the base member 130, and can rotate about a rotational axis 61*b* on the YZ plane. The rotation stop lever 70 can rotate about a rotational axis 70*b* on the YZ plane. A tension spring 72 urges a right end portion of the rotation stop lever 70 in a Z direction, and a convex portion 70*a* provided on a left end portion of the rotation stop lever 70 is urged toward the side rod support member 61. Therefore, the convex portion 70*a* of the rotation stop lever 70 engages with a concave portion 61*a* formed on the side rod support member 61 to thereby hold the side rod 10 at the engagement position, namely, at the engagement angle. Hereinafter, as illustrated in FIG. 5A, the angle of the side rod 10 obtained by engaging the convex portion 70*a* of the rotation stop lever 70 and the concave portion 61*a* of the side rod support member 61 is defined as a first angle. Holding of the first angle can be released by rotating the side rod support member 61 against an urging force of the tension spring 72. On the other hand, the angle obtained by arranging the side rod 10 at a substantially horizontal position due to its own weight is defined as a second angle.

Note that, in a case where a plurality of concave portions 61*a* is provided at a side of the side rod support member 61, the angle of the side rod 10 can be adjusted to more positions in addition to the above-described two angles. The urging force of the tension spring 72 may be adequately adjusted depending on the weight of the side rod 10 and a desired holding angle.

Subsequently, an extension and contraction configuration of the side rod 10 will be described. The second side rod 10*b* can take a contraction state of being stored in the first side rod 10*a* as illustrated in FIG. 5A, and an extension state of being extended from the first side rod 10*a*. At an end portion of the second side rod 10*b* closest to the side rod support member 61, a position holding lever 81 for determining an engagement position with respect to the first side rod 10*a* is attached. In the contraction state, the position holding lever 81 is engaged with a first position holding lever follower 84 provided near the side rod support member 61 of the first side rod 10*a*. On the other hand, in the extension state, the position holding lever 81 is engaged with a second position holding lever follower 85 provided at a position away from the side rod support member 61 of the first side rod 10*a*.

FIG. 5C illustrates an engagement state of the position holding lever 81 and the first position holding lever follower 84 in the contraction state. FIG. 5C is an enlarged view of a region surrounded using a broken line circle VC in FIG. 5A. The position holding lever 81 is attached to a lever holder 82 fixed to an end portion of the second side rod 10*b*. The position holding lever 81 can be rotated about an axis 81*b* serving as a rotational axis on a plane orthogonal to the extension direction of the side rod 10, and is urged by a compression spring 83 toward the first position holding lever follower 84 provided on a side surface of the first side rod 10*a*. Then, a position holding portion 81*a* provided on a side of the position holding lever 81 of the second side rod 10*b* is engaged with a position holding portion 84*a* provided on a side of the first side rod 10*a* to thereby hold the contraction state. In a state where the contraction state is changed into the extension state, the user rotates the position holding lever 81, namely, the second side rod 10*b* against the urging force of the compression spring 83 and releases the engagement, and then, extends the second side rod 10*b* from the first side rod 10*a*.

FIG. 5D illustrates the second position holding lever follower 85 with which the position holding lever 81 is engaged in the extension state. FIG. 5D is an enlarged view of a region surrounded using a broken line circle VD in FIG. 5A. The second position holding lever follower 85 and the position holding portion 85*a* have, respectively, the same shape as the first position holding lever follower 84 and the position holding portion 84*a*. Namely, after the second side rod 10*b* is extended, it is rotated about the rotational axis 81*b*, whereby the position holding portion 81*a* of the second side rod 10*b* and the position holding portion 84*a* of the first side rod 10*a* can be engaged via the compression spring 83, thereby being able to realize the extension state.

As described above, the user rotates the second side rod 10*b* about the rotational axis 81*b*, and extends and contracts the second side rod 10*b* with respect to the first side rod 10*a* to thereby be able to switch a state between the contraction state and the extension state. Note that, in a case where a plurality of position holding lever followers is provided on a side of the first side rod 10*a*, a length of an entire side rod 10 can be adjusted to more levels. The urging force of the compression spring 83 may be adequately adjusted in accordance with the weight and the length of the side rod 10.

As described above, the side rod 10 of the present embodiment can change each of its length and angle by at least two levels. As a result, the position of the top rod 20 and the posture of the reception sheet 40 can be adjusted in various ways in accordance with the length and a setting angle of the side rod 10.

Next, a setting position of the rear rod 30 will be described in detail. With reference to FIG. 1A once again, the rear rod 30 of the present embodiment can be mounted on three positions of a rear rod holder 33 fixed to each leg unit 2 on the both sides, an upper hole 91 and a lower hole 92 provided in front of the printer unit 1.

Figure 6A:
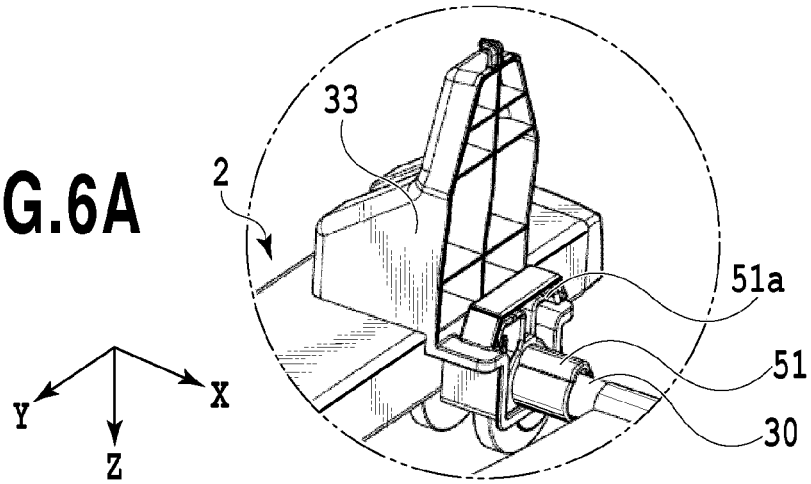
FIGS. 6A to 6C are enlarged views of a rear rod holder, an upper hole, and a lower hole.
Figure 6B:
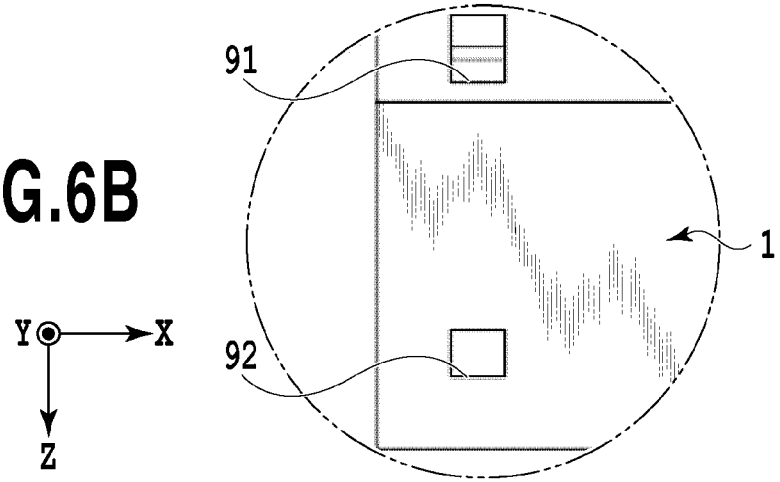
Figure 6C:
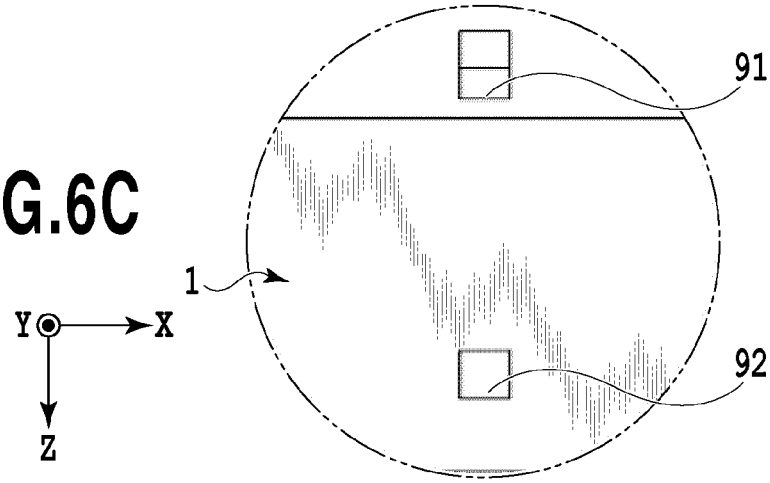

FIGS. 6A to 6C are enlarged views of the rear rod holder 33, the upper hole 91, and the lower hole 92. FIG. 6A is an enlarged view of a region surrounded using a broken line circle VIA in FIG. 1A. The rear rod holder 33 has a bottom hole, which can join the rear rod holding member 51 illustrated in FIGS. 3A and 3B. The rear rod holding member 51 is joined with the bottom hole, and thus a posture of holding the rear rod 30 behind a bottom portion of the print apparatus 1000 is realized as illustrated in FIG. 1A.

On the other hand, FIGS. 6B and 6C are enlarged views of each region surrounded using a broken line circles VIB and VIC in FIG. 1C. In front of the printer unit 1, the upper hole 91 and the lower hole 92 for hooking the hook 51*a* are formed at a position corresponding to the rear rod holding members 51 attached on both sides of the rear rod 30 and at intervals in the X direction. The rear rod 30 can be arranged substantially just below the discharge port 1*a* of the printer unit 1, by hooking right and left two hooks 51*a* on the upper hole 91. Furthermore, the rear rod 30 can be arranged at a position slightly lower than the discharge port 1*a* of the printer unit 1 in the Z direction, by hooking the right and left two hooks 51*a* on the lower hole 92. Note that a plurality of rear rod holders 33 may be provided in the Y direction of the leg unit 2, and more holes for hooking the hook 51*a* may be provided at the front of the printer unit 1.

Hereinafter, there will be described a position of the sheet holding configuration 100 that is realized in a case where the top rod 20 and the rear rod 30 are each set at various positions as described above.

FIGS. 1A to 1C described above illustrate a position in a case where the side rod 10 is brought into the contraction state at the first angle and the rear rod 30 is attached to the rear rod holder 33. Hereinafter, such a position is referred to as a rear discharge position. In the rear discharge position, the reception sheet 40 forms a mild concave shape at a position lower than the discharge port 1*a* of the printer unit 1 in the gravity direction (Z direction).

Since such a rear discharge position efficiently works in a case where a large number of print mediums are continuously discharged, since a large space between the reception sheet 40 and the discharge port 1*a* is sufficiently secured. The discharged print medium W is guided along the mild concave shape of the reception sheet 40 and is recovered at a position on an upstream side of the discharge port, namely, behind the print apparatus 1000.

Figure 7A:
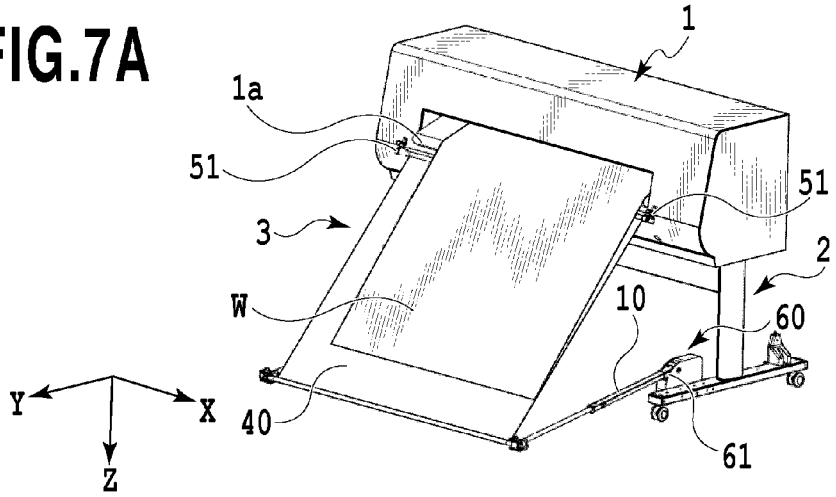
FIGS. 7A to 7C illustrate a first front discharge position.
Figure 7B:
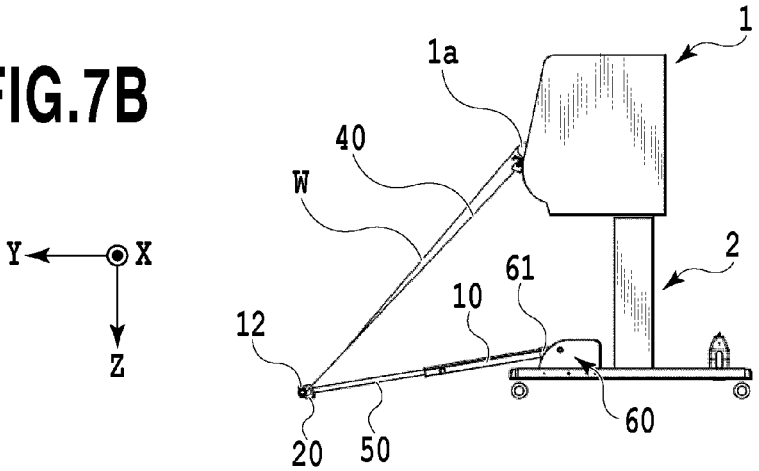
Figure 7C:
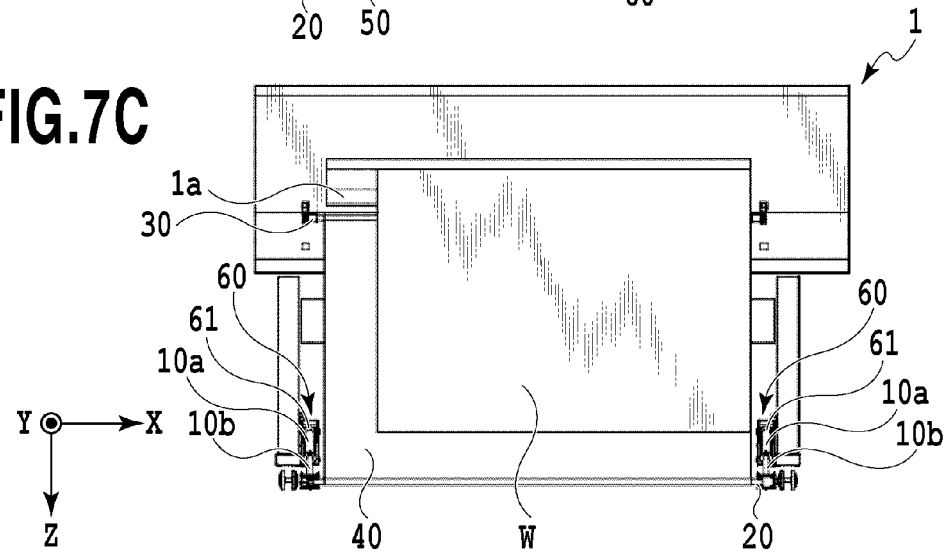

FIGS. 7A to 7C illustrate a position in a case where the side rod 10 is brought into the extension state at the second angle and the hook 51*a* of the rear rod 30 is hooked on the upper hole 91. Hereinafter, such a position is referred to as a first front discharge position. In the first front discharge position, the reception sheet 40 forms a plane substantially linearly extending forward and downward from just below the discharge port 1*a* of the printer unit 1 (+Y+Z direction).

In such a first front discharge position, the print medium W is supported by the reception sheet 40 from a time right after the print medium W is discharged from the discharge port 1*a*, and is linearly guided forward and downward. Therefore, even if the print medium W right after being printed is slightly curled, the reception sheet 40 comes into contact with a back surface of the print medium W without contacting a print surface (upper surface), and thus, can guide the print medium W forward and downward while supporting it. However, in such a first front discharge position, it is difficult to collectively receive a large number of print mediums continuously discharged, since the reception sheet 40 does not have the concave shape. The first front discharge position effectively works in a case where a comparatively large amount of photo paper having a vulnerable print surface is discharged one-by-one.

Figure 8A:
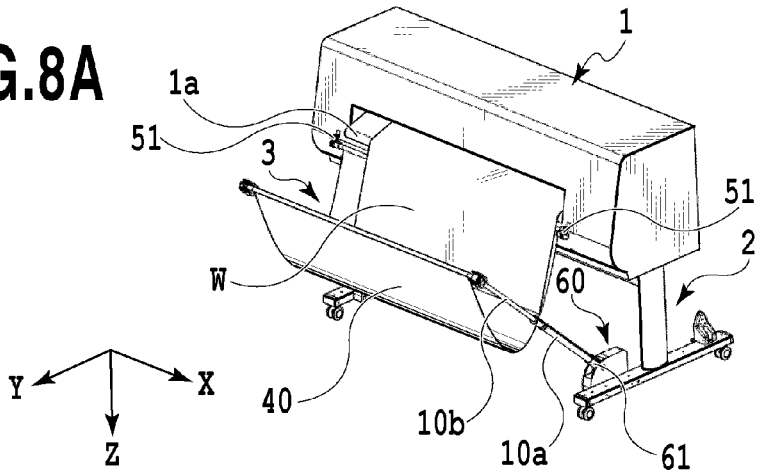
FIGS. 8A to 8C illustrate a second front discharge position.
Figure 8B:
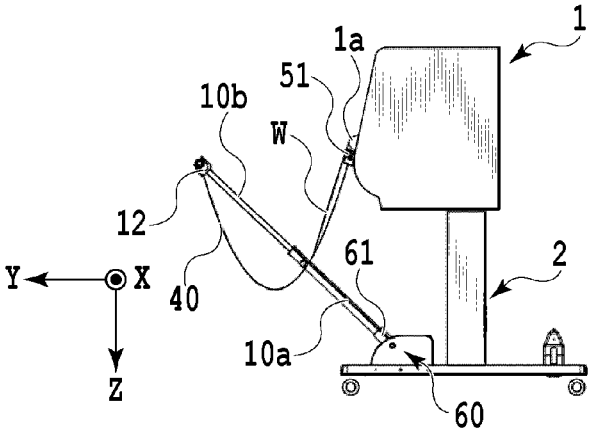
Figure 8C:
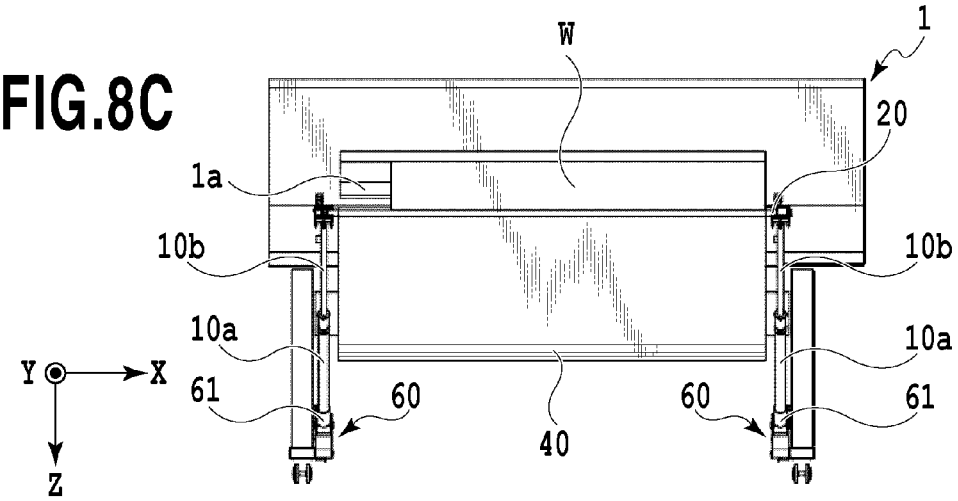

FIGS. 8A to 8C illustrate a position in a case where the side rod 10 is brought into the extension state at the first angle and the hook 51 of the rear rod 30 is hooked on the upper hole 91. Hereinafter, such a position is referred to as a second front discharge position. In the second front discharge position, the reception sheet 40 forms a bag-like concave shape in front (Y direction) of the discharge port 1*a* of the printer unit 1 from just below the discharge port 1*a*.

In such a second front discharge position, similarly to the rear discharge position described in FIGS. 1A to 1C, a large number of print mediums continuously discharged can be collectively received in the concave shape of the reception sheet 40. However, unlike the rear discharge position, the reception sheet 40 can support the print medium W from just below the discharge port 1*a*, namely, from a time right after the print medium W is discharged. Therefore, even if the print medium has a material that can be easily curled or is small-sized, the second front discharge position has an advantage that damage caused by scratch and fall is hardly generated in comparison with the rear discharge position. Furthermore, since a reception point is located at a comparatively high position in front of the print apparatus 1000, the second front discharge position has also an advantage that the user can easily take out a discharged article in comparison with the rear discharge position.

Figure 9A:
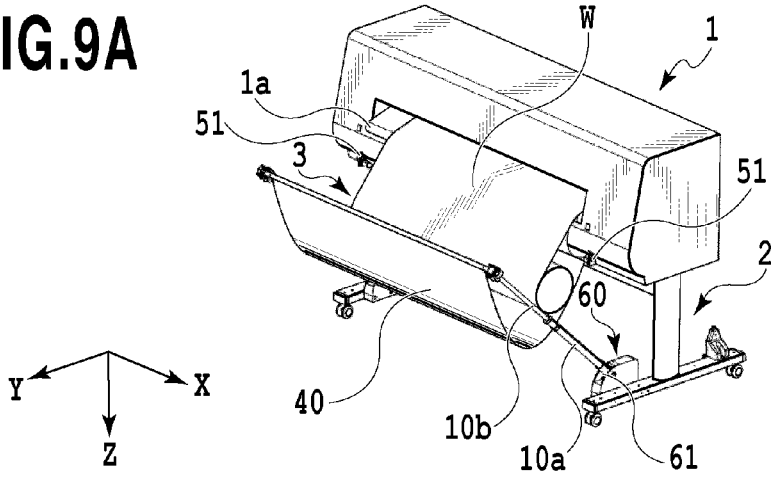
FIGS. 9A to 9C illustrate a third front discharge position.
Figure 9B:
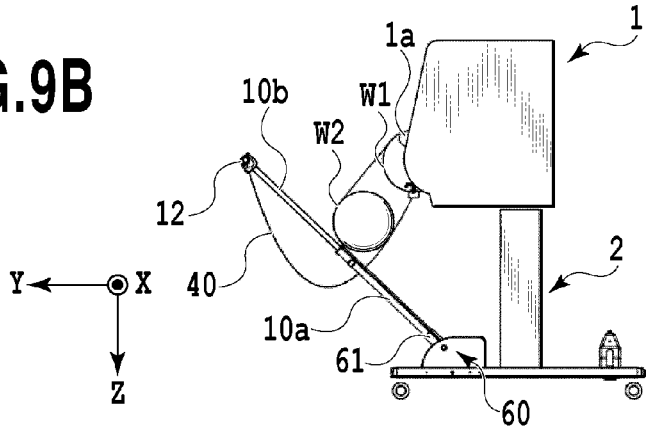
Figure 9C:
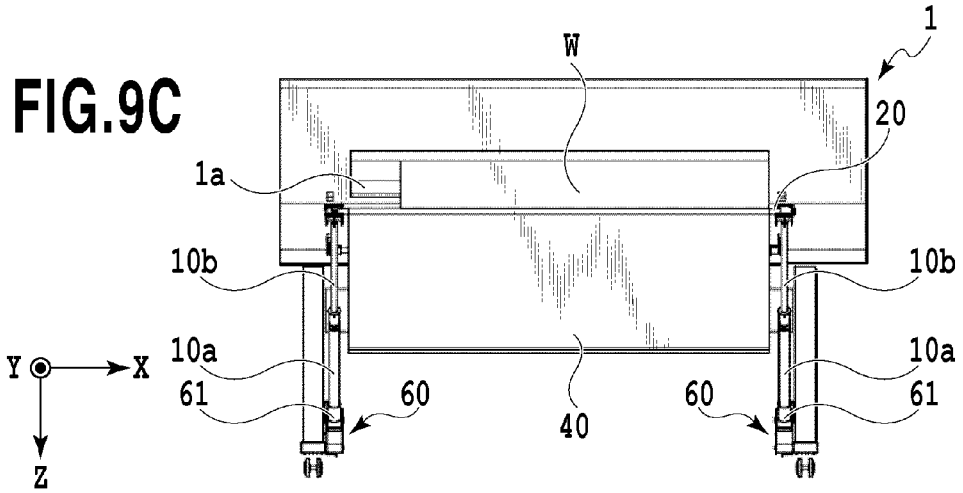

FIGS. 9A to 9C illustrate a position in a case where the side rod 10 is brought into the extension state at the first angle and the hook 51 of the rear rod 30 is hooked on the lower hole 92. Hereinafter, such a position is referred to as a third front discharge position. In the third front discharge position, similarly to the second front discharge position, the reception sheet 40 forms a bag-like concave shape in front (Y direction) of the discharge port 1*a* of the printer unit 1. However, unlike the second front discharge position, the print surface (front surface) of the print medium W is supported not from just below the discharge port 1*a*, namely, not right after being discharged, but from a position somewhat away from the discharge port 1*a*. Such a third front discharge position is effective in a case where the print medium W having strong curling tendency is discharged.

In a case of the second front discharge position, and in a case where the discharged print medium W has high rigidity and is discharged with a certain level of curvature, the print medium W supported by the reception sheet 40 just below the discharge port 1*a* may be curled at the position, whereby there is a fear that the discharge port 1*a* may be closed. In contrast, in the third front discharge position as illustrated in FIG. 9B, the print medium W is not supported by the reception sheet 40 right after being discharged. Therefore, after the print medium W has fallen in the Z direction, to some extent, following the direction of gravity, the print surface (front surface) comes into contact with and is supported by the reception sheet 40, at a position sufficiently away from the discharge port 1*a*. As a result, without the discharge port 1*a* being closed, the print medium W is in a gradually discharged state below the discharge port 1*a*, while the print surface (top surface) of print medium W is brought into contact with the reception sheet 40. In other words, a distance between the discharge port 1*a* and the lower hole 92 is set depending on the size or curling strength of the print medium W assumed to be used, so as to realize the discharge as described above. In addition, like in the present embodiment, in a case where a plurality of attaching holes having different distances to the discharge port 1*a* in the Z direction is previously arranged, the preferable reception position can be easily adjusted depending on the extent of curling and the size of the print medium.

Note that, as described above, four typical positions have been described, but more positions can be realized in a case where the angle of the side rod 10, the extension and contraction state of the side rod 10, and the attachment position of the rear rod 30 are respectively and independently changed. Namely, according to the present embodiment, a plurality of positions where the top rod 20 and the rear rod 30 can be attached is prepared, whereby the position of the sheet holding configuration 100 can be appropriately set depending on its use application.

Subsequently, a configuration of adjusting the length (reception region) of the reception sheet 40 held between the top rod 20 and the rear rod 30 in the sheet holding configuration 100 will be described. In a case where the length of the reception region can be changed, a depth and a size of a concave region receiving the print medium, and an inclined angle of the reception sheet 40 in the front discharge position can be preferably adjusted.

Figure 10A:
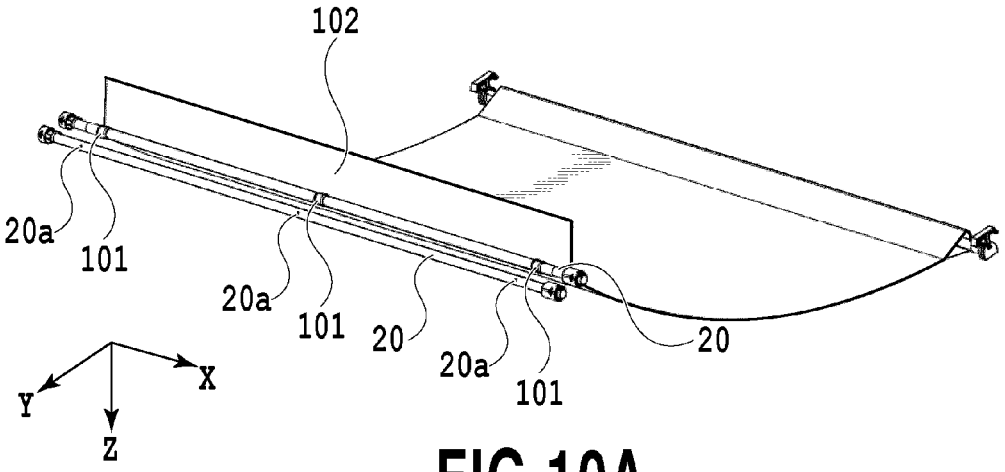
FIGS. 10A to 10C illustrate a configuration of attaching a reception sheet to the top rod.
Figure 10B:
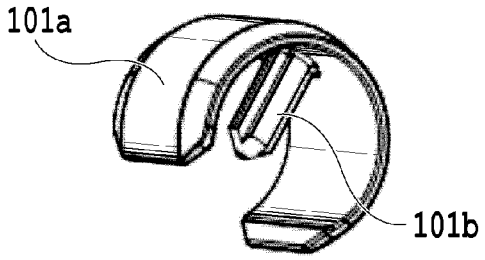
Figure 10C:
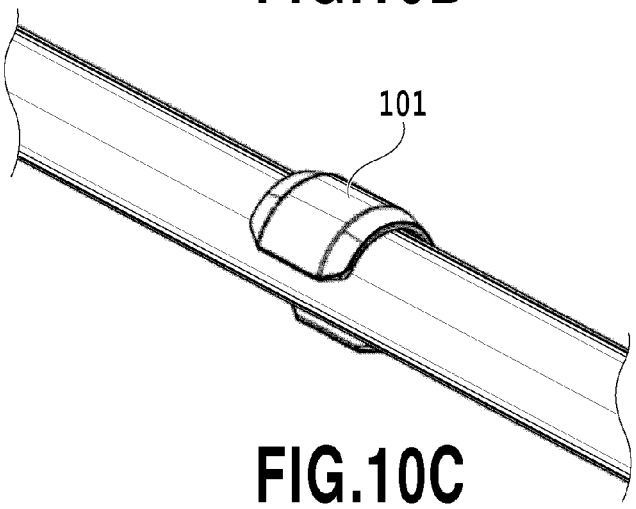

FIGS. 10A to 10C illustrate a configuration of attaching the reception sheet 40 to the top rod 20. With reference to FIG. 10A, the top rod 20 has three holes 20*a* opened in its extension direction (X direction), and the reception sheet 40 has similar holes formed at positions corresponding to the holes 20*a*. In addition, a fixing member 101 (refer to FIG. 10B) including an axis 101*b* being capable of commonly penetrating through these holes and a C-letter shape 101*a* capable of being coupled around the top rod 20 has a configuration of being joined to the top rod 20, while allowing the reception sheet 40 to wind around the top rod 20 (refer to FIG. 10C). FIG. 10A illustrates, in parallel, the top rods 20 before the reception sheet 40 is fixed, and the top rod 20 after the reception sheet 40 has been fixed. An excessive length 102 of the reception sheet 40 located at a position opposite to the rear rod 30 with respect to a fixing position is used for covering the fixing member 101. The region of the reception sheet 40 from the rear rod 30 up to the position fixed using the fixing member 101 serves as the reception region thereof. Hereinafter, some examples of mechanisms for changing the length (reception length) of the reception region will be described below.

Figure 11A:
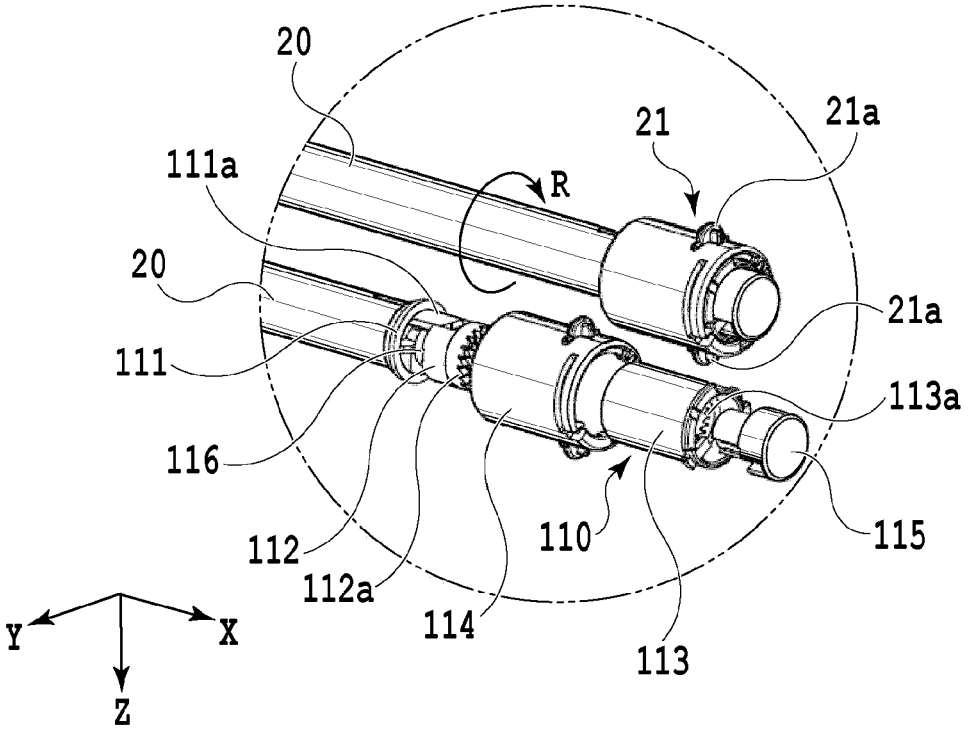
FIGS. 11A and 11B illustrate a configuration of winding unit.
Figure 11B:
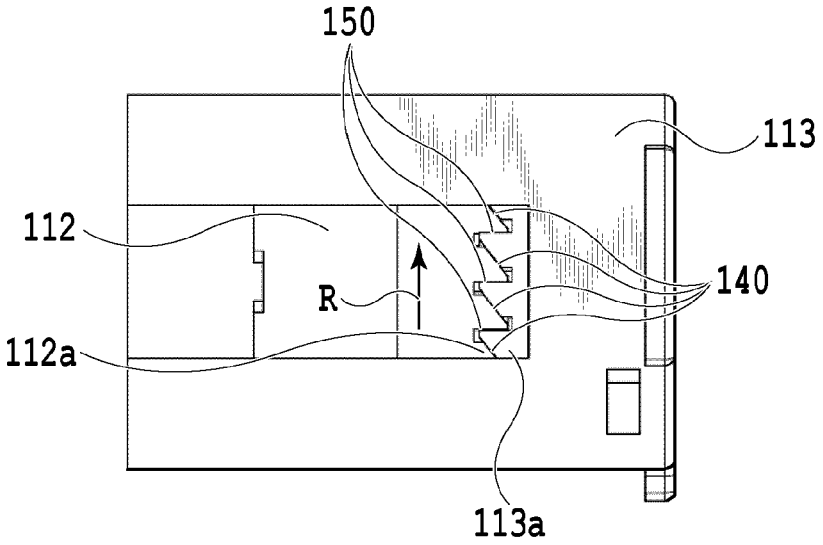

FIGS. 11A and 11B illustrate a configuration of a winding unit 110 being capable of winding a desired amount of the reception sheet 40 on the top rod 20. With reference to FIG. 11A, the winding unit 110 mainly includes a rod engagement member 111, a rotation clutch 112, a fixing clutch 113, a compression spring 116, a release button 115, and a housing 114. The rod engagement member 111 is fixed around the top rod 20, and has partly a convex portion 111*a* formed. The rotation clutch 112 engaging with the convex portion 111*a* of the rod engagement member 111 includes a saw teeth-shaped portion 112*a* on a side opposite to the engagement, and can rotate coaxially with the top rod 20. At a position facing the saw teeth-shaped portion 112*a*, a fixing clutch 113 including a saw teeth-shaped portion 113*a* meshing with the saw teeth-shaped portion 112*a* is arranged. The saw teeth-shaped portion 112*a* of the rotation clutch 112 is urged by the compression spring 116 in a direction of the fixing clutch 113 to thereby mesh with the saw teeth-shaped portion 113*a* of the fixing clutch 113. However, in a case where the user presses a release button 115 in a −X direction against the urging force of the compression spring 116, the rotation clutch 112 is separated away from the fixing clutch 113. The housing 114 covers the above-described mechanism to protect it in a state where the housing 114 is not fixed to the rod engagement member 111 but fixed to the fixing clutch 113. Namely, in the configuration described above, the top rod 20, the rod engagement member 111, and the rotation clutch 112 integrally rotate, and the housing 114 and the fixing clutch 113 integrally rotate independently from the above-described rotation. FIG. 11A illustrates, in parallel, the states where each mechanism is removed from the housing 114 and where each mechanism is covered by the housing 114. Note that, an outer circumference of the housing 114 is, as a first coupling unit of the top rod 20, joined to the U-shaped joint portion 12 provided at a leading end of the second side rod 10*b*.

FIG. 11B is an enlarged view of an engagement portion between the rotation clutch 112 and the fixing clutch 113. In a case where the user rotates the top rod 20 in an R direction as illustrated in FIG. 11B, that is, in a winding direction of the reception sheet in a state where the top rod 20 is engaged with the joint portion 12 of the side rod 10, the rod engagement member 111 and the rotation clutch 112 each coupled to the top rod 20 interlock with the rotation. However, the housing 114 engaged with the joint portion 12 and the fixing clutch 113 integrated with the housing 114 are not interlocked. Therefore, the saw teeth-shaped portion 112*a* of the rotation clutch 112 proceeds along a tapered surface 140 against the compression spring 116, and rotates in the Y direction while repeating separation from and coupling with the saw teeth-shaped portion 113*a* of the fixing clutch 113. Namely, the user can wind the reception sheet 40 on the top rod 20 while sensing some load.

On the other hand, even if a force in a −R direction is applied on the top rod 20 by some external forces, the saw teeth-shaped portion 112*a* of the rotation clutch 112 is abutted on a stopper face 150 to inhibit rotation in the −R direction. Namely, even if a large number of the print mediums are received in the concave portion of the reception sheet 40 after the user has adjusted a reception length of the reception sheet 40 to a desired length by rotating the top rod 20 in the R direction, the amount of winding the top rod 20 is not largely changed due to the weight. That is, according to the present embodiment, while the reception length of the reception sheet receiving the discharged article is appropriately set in accordance with the purpose, the adjusted reception length can be maintained in use. Note that, in a case where the reception length is required to be newly adjusted, the rotation clutch 112 is completely separated from the fixing clutch 113 by pressing the release button 115, so that the top rod 20 can also rotate in the −R direction. Note that the winding unit as described above may be provided in both of the right and left two first engagement units, but may be arranged in either one of the first engagement units.

The configuration in which rotation can be performed only in the R direction is described in FIG. 11B. However, in a case where relationship between slope of the tapered surface 140 and a stopper surface 150, at the engagement portion between the saw teeth-shaped portion 112*a* and the saw teeth-shaped portion 113*a*, is reversed, only the rotation in the −R direction can be allowed. In this case, in a case where the winding direction with respect to the top rod 20 is reversed, the same effects as described above can be obtained. For example, in a case where the winding direction is set to the R direction (clockwise direction viewed from the +X direction), the reception sheet 40 is wound with the front surface of the reception sheet 40 facing inside, on the top rod 20. In this case, the leading end of the print medium proceeding along the front surface of the reception sheet 40 is abutted on a circumference of the winding around the top rod 20, and then the proceeding is inhibited. Namely, such a configuration works effectively in a case where a large number of short print mediums are discharged. On the other hand, in a case where the winding direction is set to the −R direction (anticlockwise direction viewed from the +X direction), the reception sheet 40 is wound with the front surface of the reception sheet 40 facing outside, on the top rod 20. In this case, the leading end of the print medium proceeding along the front surface of the reception sheet 40 smoothly proceeds along the circumference of the winding around the top rod 20. That is, such a configuration is effective in a case where the long print medium is discharged.

Furthermore, in a case where one-way clutch is not particularly needed, a configuration in which the tapered surface having reversed slopes are alternately arranged may be applied for the engagement portion between the saw teeth-shaped portion 112*a* and the saw teeth-shaped portion 113*a*. With the arrangement described above, the user can easily perform fine adjustment on the reception length by forward and backward rotation of the top rod. Naturally, the load at the time of operation can be adjusted by changing a compression force of the compression spring 116.

Figure 12A:
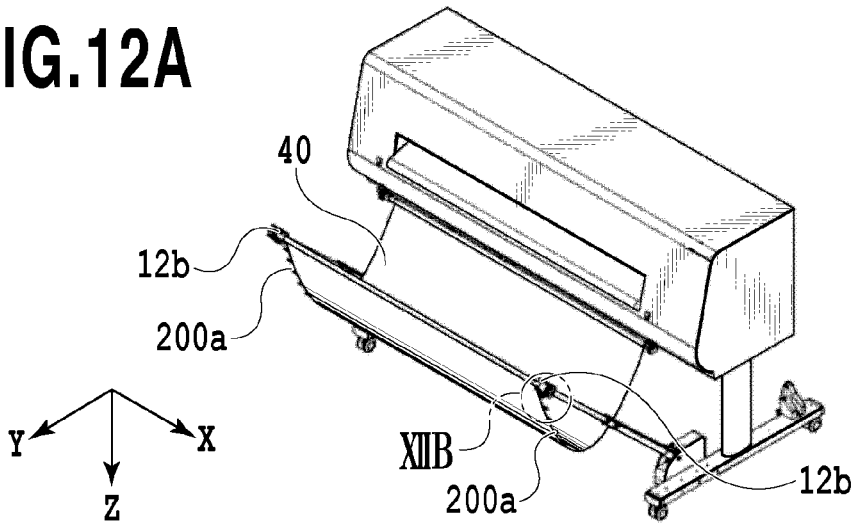
FIGS. 12A to 12C illustrate another example of a mechanism changing a reception length.
Figure 12B:
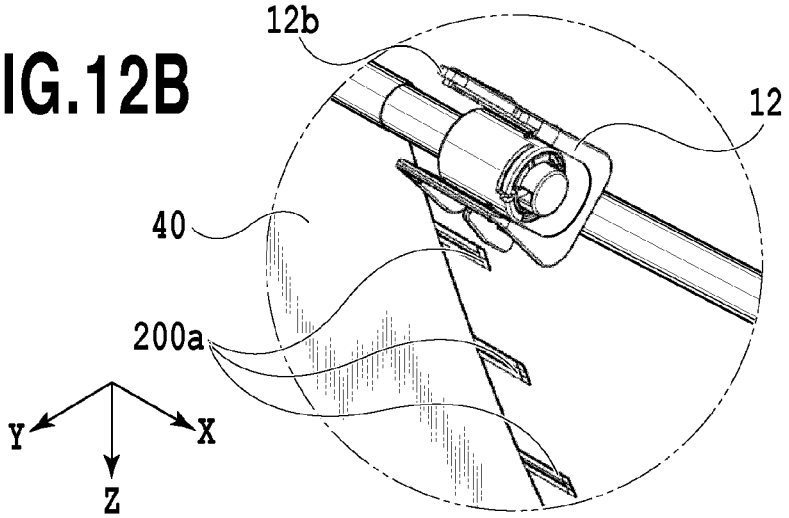
Figure 12C:
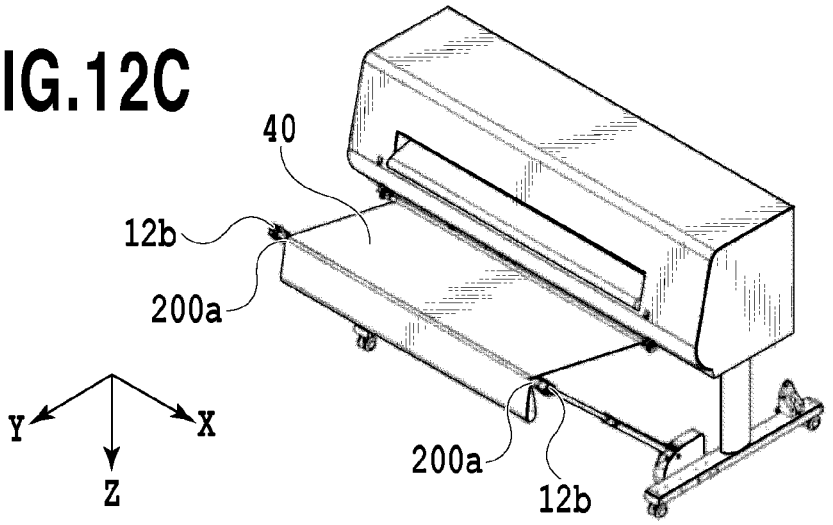

FIGS. 12A to 12C illustrate another example of a mechanism changing the reception length. FIG. 12A is a perspective view of the print apparatus 1000. FIG. 12B is an enlarged view of a region surrounded using a broken line circle XIIB in FIG. 12A. With reference to FIGS. 12A and 12B, in the present example, a plurality of closed string portions 200*a* is formed at a predetermined pitch at the both ends of the reception sheet 40 in the X direction. On the other hand, on the joint portion 12 attached to the leading end of the second side rod 10*b*, a hook 12*b* capable of hooking a string portion 200*a* is formed. In such a configuration, the user hooks, on the hook 12*b*, the string portion 200*a* located at a position where the desired reception length can be realized, whereby the length of the reception region can be easily adjusted.

In a case where the reception length is required to be sufficiently shortened, since the string portion 200*a* located at the middle portion of the reception sheet 40 is hooked on the hook 12*b*, it is assumed that the leading end of the reception sheet 40 protrudes from the top rod 20 and hangs down. Even in such a case, as illustrated in FIG. 12C, the reception sheet 40 is folded and the plurality of string portions 200*a* is hooked on the hook 12*b* all together, whereby hanging-down of the leading end of the reception sheet 40 and dirt caused by the hanging-down can be avoided.

Figure 13A:
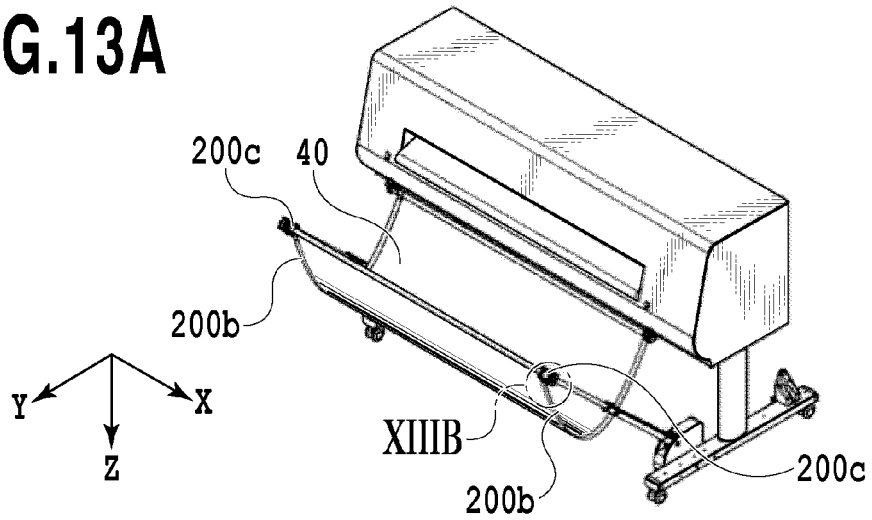
FIGS. 13A to 13C illustrate another example of a mechanism changing a reception length.
Figure 13B:
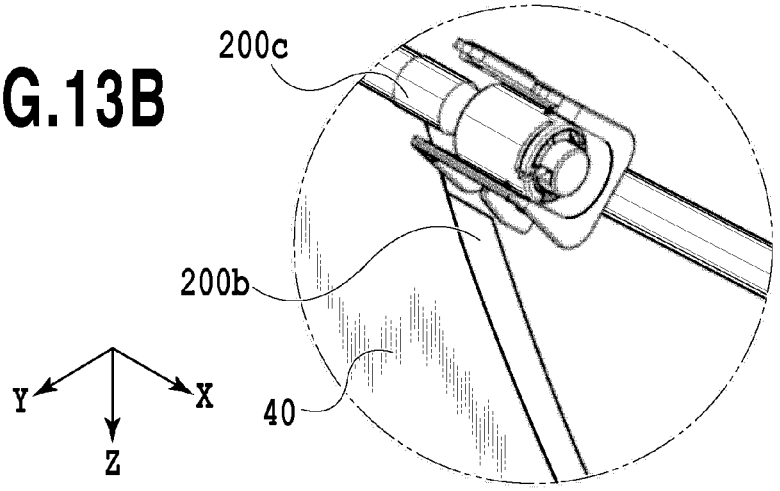
Figure 13C:
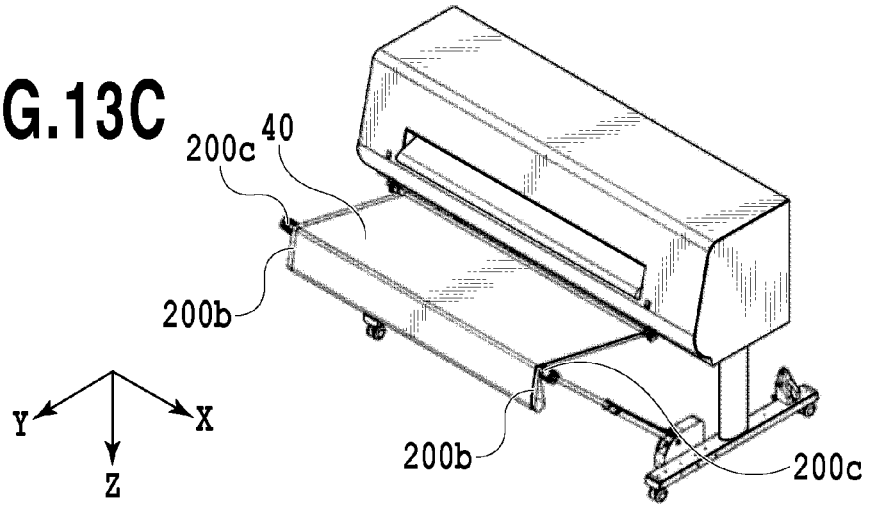

FIGS. 13A to 13C further illustrate another example of a mechanism changing the length of the reception region. FIG. 13A is a perspective view of the print apparatus 1000, and FIG. 13B is an enlarged view of a region surrounded using a broken line circle XIIIB in FIG. 13A. With reference to FIGS. 13A and 13B, in the present example, a hook-and-loop fastener 200*b* is made to adhere along an end side portion of the reception sheet, on the both ends of the reception sheet 40 in the X direction. On the other hand, in the top rod 20, a fixing hook-and-loop fastener 200*c* removable from and replaceable on the hook-and-loop fastener 200*b* is arranged at a position corresponding to the hook-and-loop fastener 200*b* in the X direction. In such a configuration, the user makes the hook-and-loop fastener 200*b* adhere onto the fixing hook-and-loop fastener 200*c* at a position where the desired length can be realized, and thus the length of the reception region can be easily adjusted. Also in the present example, as illustrated in FIG. 13C, the hook-and-loop fastener 200*b* and the fixing hook-and-loop fastener 200*c* are made to adhere to each other in a state where the reception sheet is folded, whereby hanging-down of the leading end of the reception sheet 40 and dirt caused by the hanging-down can be avoided.

As described above, the reception length held between the top rod 20 and the rear rod 30 can be easily adjusted at many levels by adoption of the configuration described above using FIGS. 10A to 10C, 11A and 11B, 12A to 12C, and 13A to 13C. As a result, the depth and the size of the concave region receiving the print medium, and the inclined angle of the reception sheet 40 in the front discharge position, and the like can be adequately adjusted depending on the size of the print medium and an amount of discharge thereof, and usability of a user. Note that, although the reception length is adjusted by winding the reception sheet 40 on the top rod 20 as described above, the configuration described using FIGS. 10A to 10C, 11A and 11B, 12A to 12C, and 13A to 13C may be provided on a side of the rear rod 30, or on both sides of the top rod 20 and the rear rod 30.

Figure 14A:
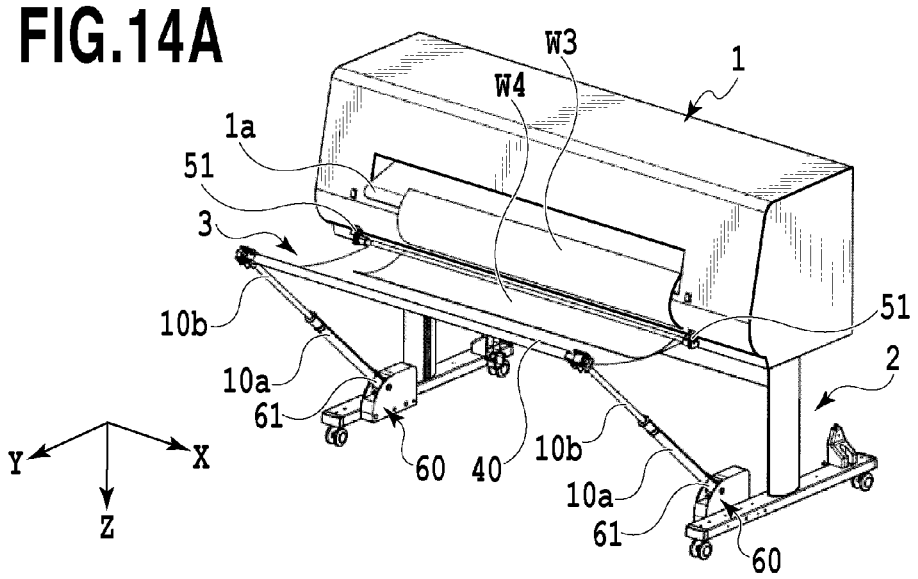
FIGS. 14A to 14C illustrate a position in which the reception length is shortened at the third front discharge position.
Figure 14B:
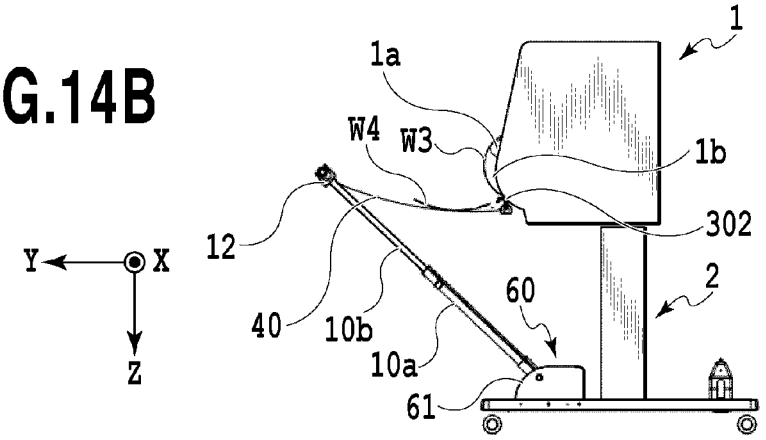
Figure 14C:
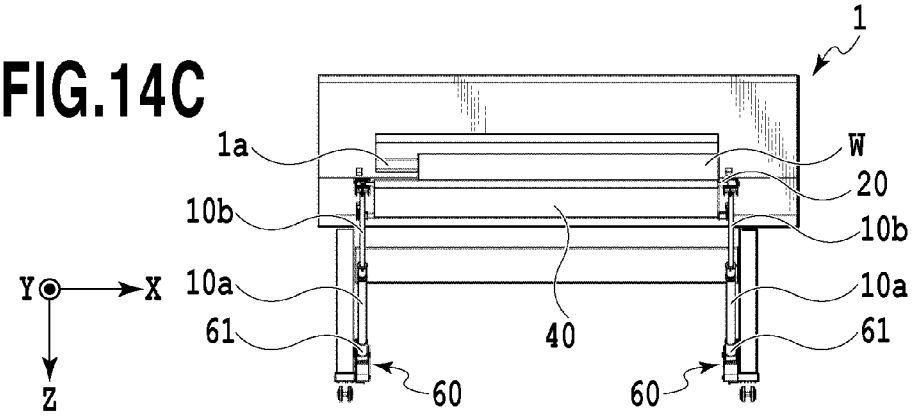

FIGS. 14A to 14C illustrate a state where the reception length is shortened using the clutch mechanism described with reference to FIGS. 10A to 10C, in the third front discharge position illustrated in FIGS. 9A to 9C. The shortened reception length makes the reception region between the top rod 20 and the rear rod 30 to be a substantially flat and smooth surface having a rising gradient. FIGS. 14A to 14C illustrate a state where the print mediums W having curling tendency, cut into an A4 landscape size, are continuously discharged.

Figure 15:
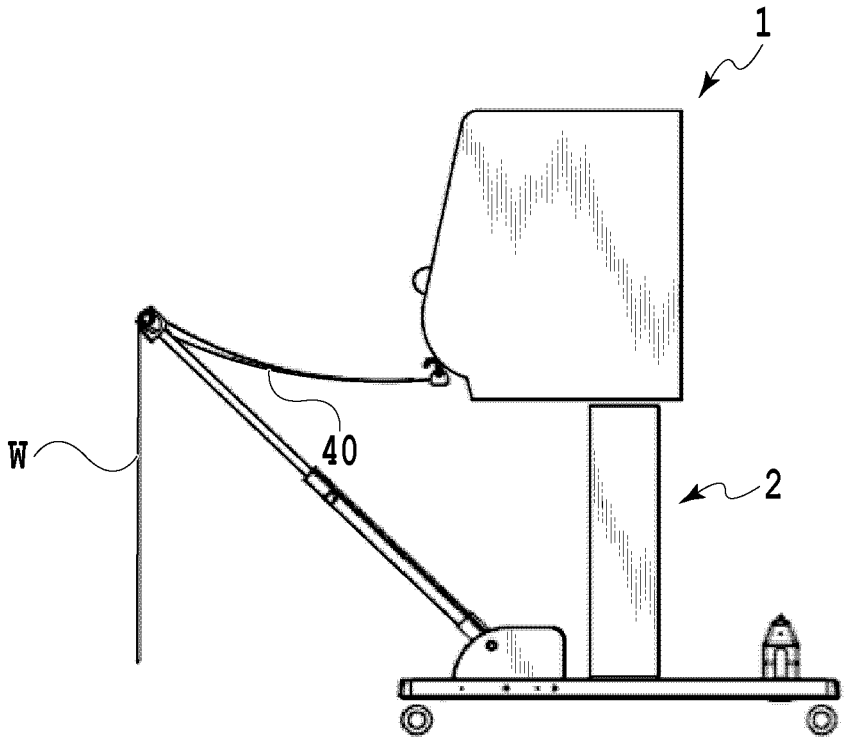
FIG. 15 illustrates a reception state diagram in a case where a long print medium is discharged in a state of FIGS. 14A to 14C.

On the other hand, FIG. 15 illustrates a reception state, in the state described above, in a case where the print medium being sufficiently longer than a standard size is discharged in a state of being curled. The print medium W discharged from the discharge port 1*a* is supported along the reception sheet 40 which is a comparatively flat surface, and a region after the print medium W goes over the top rod 20 hangs down in the Z direction due to its own weight. Then, in a case where the print medium W is cut at a rear end of an image, a front of the print medium W hangs down in the Z direction in a state of being supported by the top rod 20, and a rear thereof is received in contact with the reception sheet 40.

The first front discharge position illustrated in FIGS. 7A to 7C has been described as being effective in a case where the comparatively large photo sheet is discharged one-by-one. However, in a case where the rear end of the print medium W is cut, the print medium W is likely to slide down along the flat and smooth reception sheet 40. On the other hand, as described in the present example, in the configuration in which the print medium is hung down in the vicinity of the top rod 20 located at a top point or supported on an inclined surface, the print medium does not slide in the Y direction or −Y direction, but is reliably received by the reception unit 3.

On the other hand, in a case where the print medium is comparatively small and a length in a discharge direction is shorter than a distance between the discharge port 1*a* and the lower hole 92 as illustrated in FIG. 14B, the leading end of the print medium discharged while being curled is discharged toward the front surface of the printer unit 1 (W3). Then, in a case where the print medium is cut before the leading end of the print medium is abutted on the front surface of the printer unit 1 or the reception sheet 40, the print medium falls down while being inverted, and the print medium is received in a state where its print surface is in contact with the reception sheet 40 (W4). At this time, in a case where the discharge guide 1*b* for guiding the print medium along the curled print medium just below the discharge port 1*a*, and a recessing portion 302 hooking the leading end of the print medium guided along the guide are previously arranged, the above-described inversion and falling-down are performed more smoothly.

Here, for example, in a case where the reception sheet 40 is a substantially horizontal plane, the print medium previously discharged moves more easily in a downstream direction (+Y direction), and thus, loading positional deviation may be generated among the print mediums previously discharged and subsequently discharged. In contrast, as described in the present example, in a case where the reception sheet 40 includes a plane having a rising gradient in the +Y direction, movement of a first print medium in the +Y direction can be suppressed.

Furthermore, in the present example, the reception sheet 40 wound on the top rod 20 is slightly drawn out due to the weight of the discharged print medium. At this time, a reception surface is transformed such that the reception surface changes from a planar shape into a curved shape (i.e., a concave shape, or a convex shape viewed downward in a different direction) that is warped downward in the gravity direction. Therefore, in a case where a new print medium is discharged, the reception sheet 40 having slackness easily comes into contact with the curled surface of the new print medium so that the print mediums can be orderly loaded at a predetermined position.

At this time, the reception sheet 40 can be kept substantially flat and smooth until the first print medium is discharged, and after the first print medium is discharged, the following method can be adopted as a method for applying some extent of slackness to the reception sheet 40.

For example, there is one method in which a soft and elastic fiber such as polyester is used as a material of the reception sheet 40. In a case of such a reception sheet, the discharged print medium falls on and comes into contact with the reception sheet 40, thereby extending the reception sheet 40, and the print medium can be loaded at the predetermined position.

Figure 16A:
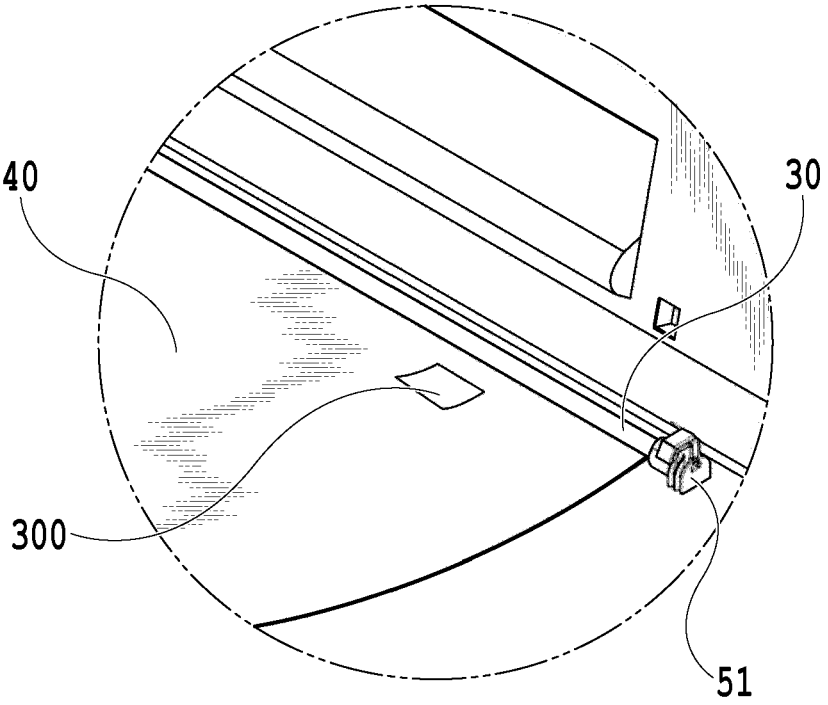
FIGS. 16A and 16B illustrate a setting state diagram of a sensor detecting the presence or absence of a discharged print medium.
Figure 16B:
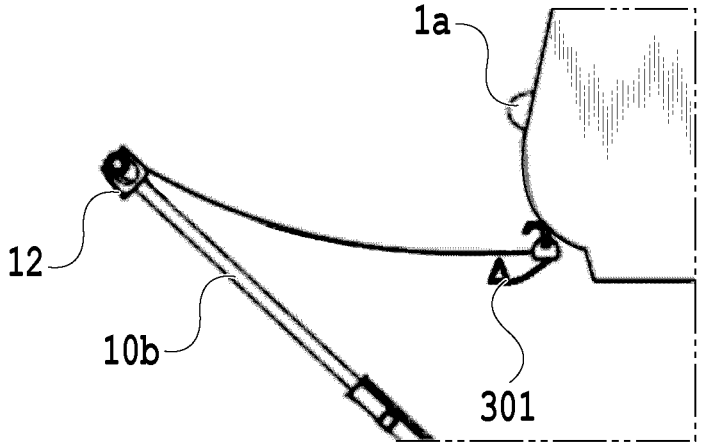

Furthermore, a sensor detecting whether or not the discharged print medium exists on the reception sheet 40 is prepared, and thus a holding state of the reception sheet 40 depending on a detection result of the sensor can also be more positively changed. FIGS. 16A and 16B are a perspective view and a cross-sectional view illustrating a setting state of the sensor detecting whether or not the discharged print medium exists on the reception sheet 40. A sensor 301 is a transmission-type optical sensor arranged lower than the discharge port 1*a* at the front surface of the printer unit 1, and detects whether or not the print medium exists on the reception sheet 40 via a notch hole 300 formed on the reception sheet 40.

Figure 17A:
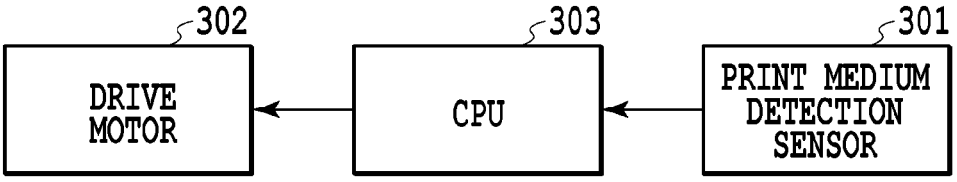
FIGS. 17A and 17B are a block diagram and a flowchart illustrating a method of changing a posture of the reception sheet.
Figure 17B:
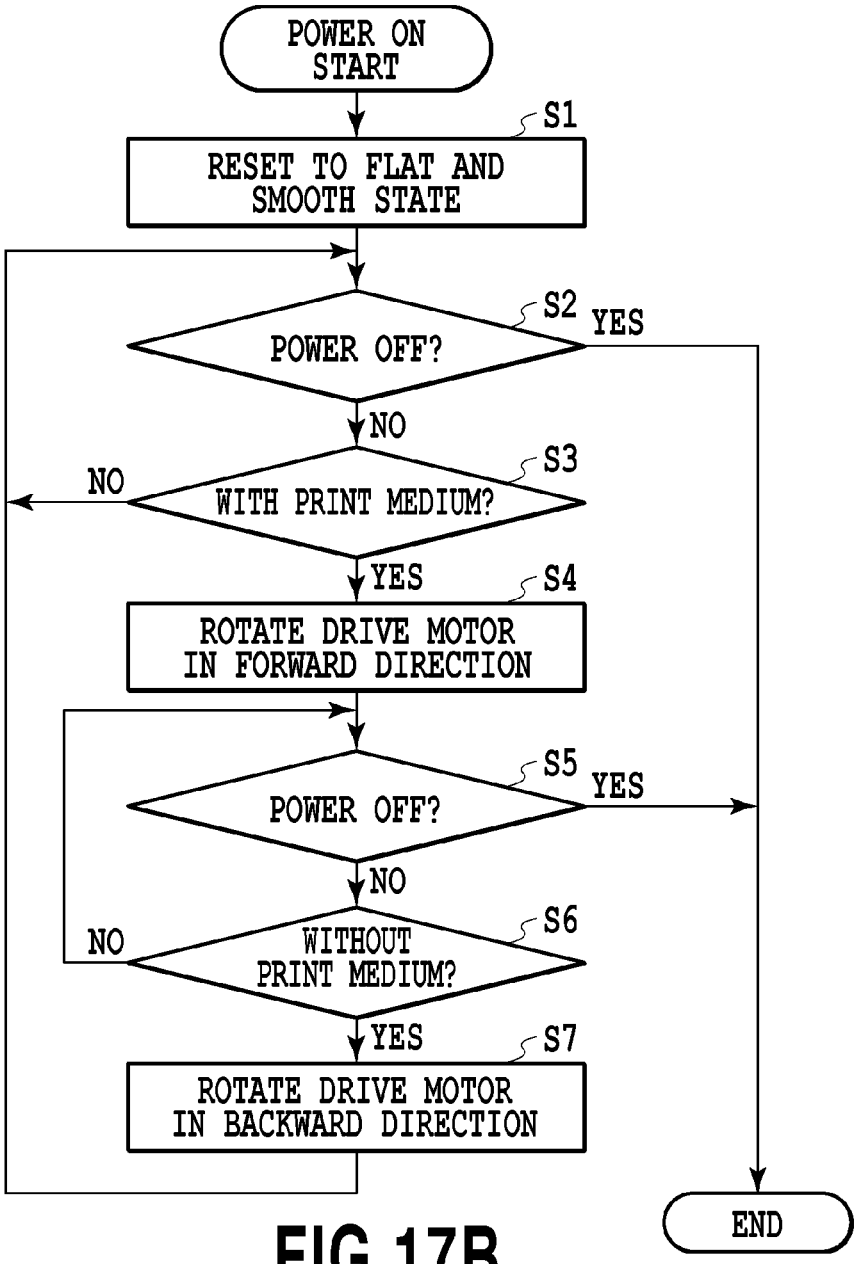

FIGS. 17A and 17B are a block diagram and a flowchart, respectively, for illustrating a method in which a CPU 303 included in the print apparatus 1000 changes a posture of the reception sheet 40 on the basis of the detection result of the sensor 301. In the present example, a drive motor 302 being capable of changing an angle of the side rod 10 is included in the side rod angle holding unit 60, and the CPU 303 drives and controls the drive motor 302 depending on the detection result of the sensor 301 to thereby adjust the angle of the side rod 10.

Hereinafter, the method will be described along with the flowchart in FIG. 17B. Once the processing is started by turning on a power of the print apparatus 1000, the CPU 303 first, in step S1, resets the posture of the reception sheet 40 to a flat and smooth state having no slackness.

Subsequently, in step S2, the CPU 303 confirms whether or not the power is turned off. In a case where the power is not turned off, the CPU 303 proceeds to step S3 to determine whether or not the print medium is present on the reception sheet 40 on the basis of the detection result of the detection sensor. In a case where it is determined that the print medium is not present, the CPU 303 returns to step S2 and repeatedly performs step S2 and step S3 until it is determined that the print medium is present.

In a case where it is determined that the print medium is present in step S3, the CPU 303 proceeds to step S4 to rotate the drive motor 302 by a predetermined amount in a forward direction. Along with the rotation, the side rod 10 is rotated, and the flat and smooth surface formed between the top rod 20 and the rear rod 30 is slacked in a curved, concave shape (convex shape downward). As a result, the curled surface of the discharged print medium is supported by the reception sheet 40 having slackness and held at a predetermined position.

Further, the CPU 303 proceeds to step S5 to confirm whether or not the power is turned off. In a case where the power is not turned off, the CPU 303 proceeds to step S6 and determines whether or not the print medium is present on the reception sheet 40 on the basis of the detection result of the detection sensor. In a case where the print medium is still present, the CPU 303 returns to step S5 and repeatedly performs step S5 and step S6 until it is determined that the print medium is not present.

In a case where the user collects the print medium, for example, and the sensor 301 detects that the print medium is not present on the reception sheet 40, the CPU 303 proceeds to step S7 and rotates the drive motor 302 in a backward direction. Along with this rotation, the side rod 10 is rotated in an opposite direction and the reception sheet 40 located between the top rod 20 and the rear rod 30 forms again the rising gradient surface that is flat and smooth. Subsequently, the CPU 303 returns to step S2 again.

On the other hand, in a case where it is confirmed that the power is turned off in step S2 or step S5, the processing is finished. In a case where it is determined that the power is turned off in step S2, the reception sheet 40 maintains a position having the flat and smooth surface until the power is turned on next. In a case where it is confirmed that the power is turned off in step S5, the reception sheet 40 maintains a position where the reception sheet 40 has slackness until the power is turned on next. However, in a case where the power is turned on next, since resetting to a position having the flat and smooth surface is performed in step S1, even in a case where the power is turned off in either state, the above-described processing can be performed without any trouble.

Note that, in step S1, for example, a method may be adopted in which a torque limiter is arranged in the middle of a drive transmission path between the drive motor 302 and the side rod 10, and then the drive motor is driven in a backward direction. With this arrangement, the position can be reset without applying load on the drive motor. Furthermore, although in FIGS. 16A to 17B, the configuration has been described in which the position of the reception sheet 40 is switched depending on the presence or absence of the print medium, a configuration may be such that for example, the number of the loaded print mediums and the weight thereof is measured and the side rod 10 is gradually rotated depending on the measurement result. With this arrangement, the print mediums can be more stably loaded by keeping the highest position of the loaded print mediums at a substantially constant height.

As described above, the reception sheet 40 is kept substantially flat and smooth until the first print medium is discharged, and after discharging the first print medium, a certain slackness is given to the reception sheet 40, whereby the plurality of print mediums can be orderly loaded.

Figure 18A:
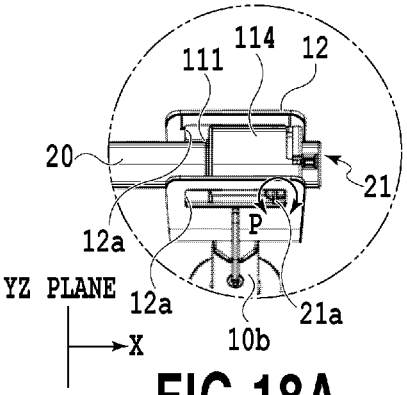
FIGS. 18A to 18F illustrate a coupling state between the first engagement unit and a joint portion.
Figure 18B:
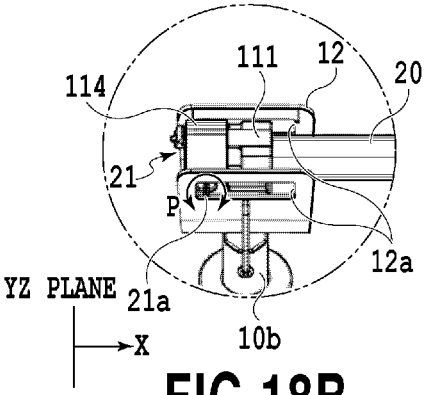

Next, a coupling configuration between the top rod 20 and the side rod 10 will be described in detail. FIGS. 18A to 18F illustrate the coupling state between the first engagement unit 21 of the top rod 20 and the joint portion 12 of the side rod 10. FIGS. 18A and 18B are enlarged views of regions surrounded using broken line circles XVIIIA and XVIIIB in FIG. 4, and illustrate each of the coupling positions on a right side and a left side in a case of being viewed from the front (−Y direction). The top rod 20 and the side rod 10 are coupled such that the outer circumference of the housing 114 is fitted into the U-shaped joint portion 12 on the coupling positions on the right and left sides. In the joint portion 12, at both U-shaped side surfaces, long hole portions 12*a* having the same shape are formed facing each other so as to extend in the X direction. In addition, in a case where the first engagement unit 21 is coupled with the joint portion 12, the two projecting portions 21*a* attached to the housing 114 are inserted into the long hole portions 12*a* to be fitted therein.

Figure 18C:
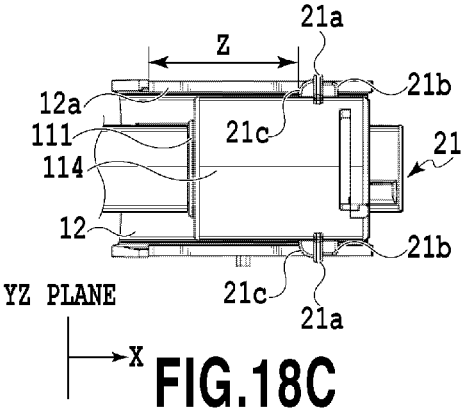
Figure 18D:
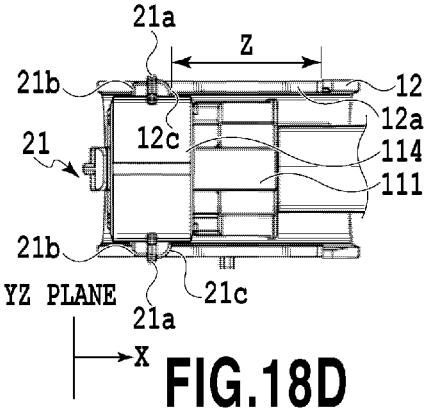

FIGS. 18C and 18D illustrate FIGS. 18A and 18B viewed toward the U-shaped bottom surface of the joint portion 12, respectively. A shape of the projecting portion 21*a* in the X direction will be described in detail. The projecting portion 21*a* includes a straight shape 21*b* on an outside surface of the top rod 20 in a width direction (X direction), and a circular arc shape 21*c* on an inside surface thereof. Therefore, the first engagement unit 21 can move in the X direction within an area corresponding to a length of the hole portion 12*a*, and can also rotate about the projecting portion 21*a* in a P direction. In such a configuration, in a state where the top rod 20 is attached to the side rod 10, the straight shape 21*b* formed on the outside surface of the projecting portion 21*a* and an inner wall of the long hole portion 12*a* face each other in an axis direction of the top rod 20. Accordingly, even in a case where the load is applied on the side rod 10 at one side in the X direction, the load can be dispersed between the side rod 10 and another side rod 10 via the top rod 20.

Moreover, by adoption of the above-described configuration, a right top rod 20 and a left top rod 20 are independently attachable and removable relative to the joint portion 12 without applying excessive load on the coupling portion. For example, viewed from a point of view of a user's operation, in a case where the long top rod 20 is mounted on the side rod 10, it is natural to mount each one of the two first engagement units 21 on the joint portion 12 in order. At this point, at the period during which the first engagement unit 21 on one side has just mounted and the first engagement unit 21 on another side is in the process of being mounted, a posture of the top rod 20 is inclined with respect to the X axis. Even in such a case, with the above-described configuration, the projecting portion 21*a* of the first engagement unit 21 can be located at anywhere in the long hole portion 12*a* of the joint portion 12, and then the posture of the top rod 20 can be arranged while the projecting portion 21*a* is being slid in the long hole portion 12*a*. Furthermore, in a case where the top rod 20 is inclined too much such that the long hole portion 12*a* of the joint portion 12 cannot face the projecting portion 21*a*, a circular arc shape 21*c* goes round inside a wall of the long hole portion 12*a* and thus the first engagement unit 21 easily comes off from the joint portion 12. Namely, according to the configuration, the top rod 20 is safely attachable and removable relative to the side rod 10 in a state of having no possibility of damage. At this point, in a case where the joint portion 12 is rotatably attached to the second side rod 10*b*, operability can be further enhanced.

Figure 18E:
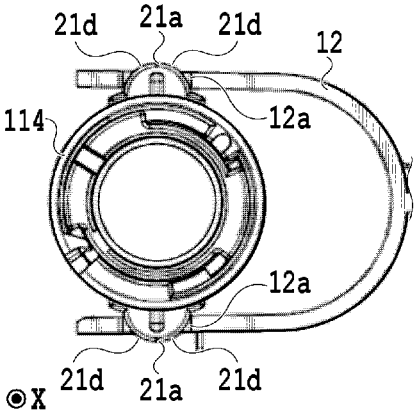
Figure 18F:
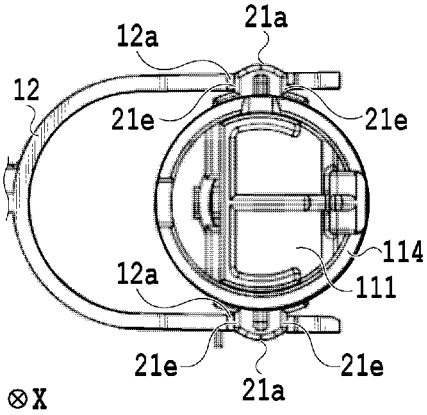

FIG. 18E is a cross-sectional view in a case where FIG. 18A is viewed in the +X direction. FIG. 18F is a cross-sectional view in a case where FIG. 18B is viewed in the −X direction. Here, the shape of the projecting portion 21*a* on the YZ plane will be described in detail. With reference to FIG. 18E, the projecting portion 21*a* of the first engagement unit 21 located at a right end portion toward the front face of the device has a circular arc shape 21*d* at a surface abutting on the long hole portion 12*a* of the side rod 10. Therefore, in a case where a predetermined amount of a rotational load or more is applied on the first engagement unit 21, the circular arc shape 21*d* of the projecting portion 21*a* rolls on the surface of the long hole portion 12*a* of the side rod 10, and thus, the first engagement unit 21 easily comes off from the joint portion 12. For example, in the winding unit 110 described in FIGS. 11A and 11B, even in a case where the user tries to rotate the top rod 20 in the −R direction by mistaking a winding direction, there is no possibility of damage or excessive load to be applied on the coupling part.

On the other hand, with reference to FIG. 18F, the projecting portion 21*a* of the first engagement unit 21 located at a left end portion toward the front surface of the apparatus has a straight surface shape 21*e* at the surface of the projecting portion 21*a* abutting on the long hole portion 12*a* of the side rod 10. Therefore, even if the rotational force is applied onto the top rod 20 on the YZ plane, the first engagement unit 21 located at the left end portion does not easily come off from the joint portion 12 due to a drag force generated between surfaces.

Hereinafter, there will be described a modification example of the position of the reception unit 3, which makes use of the fact that the projecting portion 21*a* can be tightly coupled with the long hole portion 12*a* even in a case where the top rod 20 has some inclination.

Figure 19A:
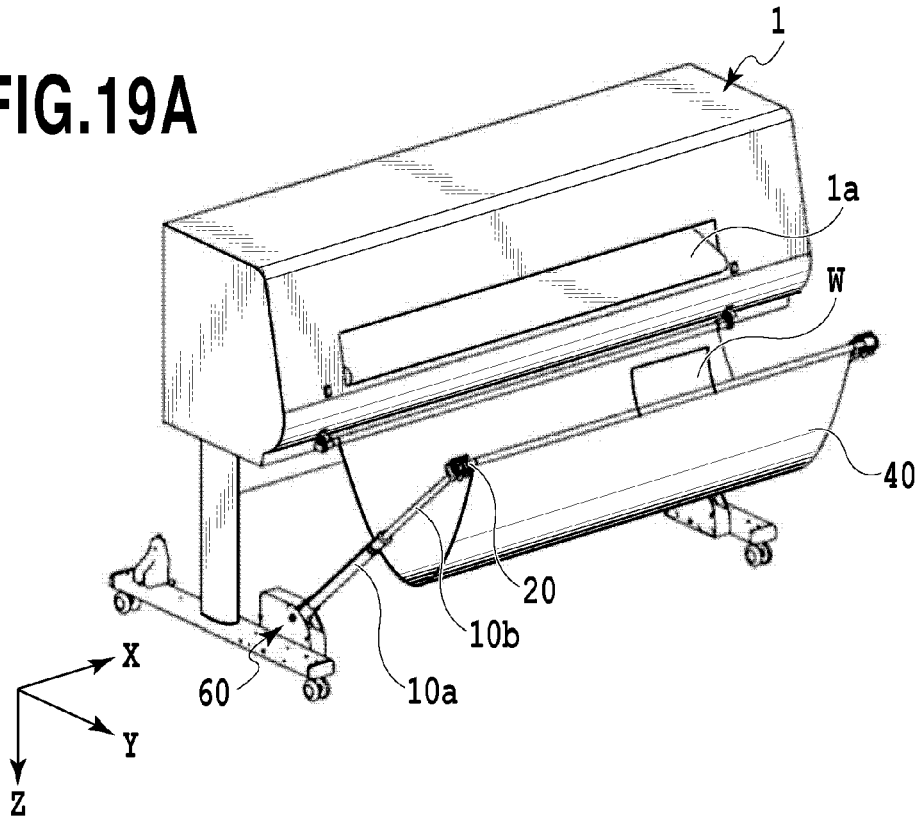
FIGS. 19A and 19B illustrate an example of a position in a case where a posture of the side rod can be independently set.
Figure 19B:
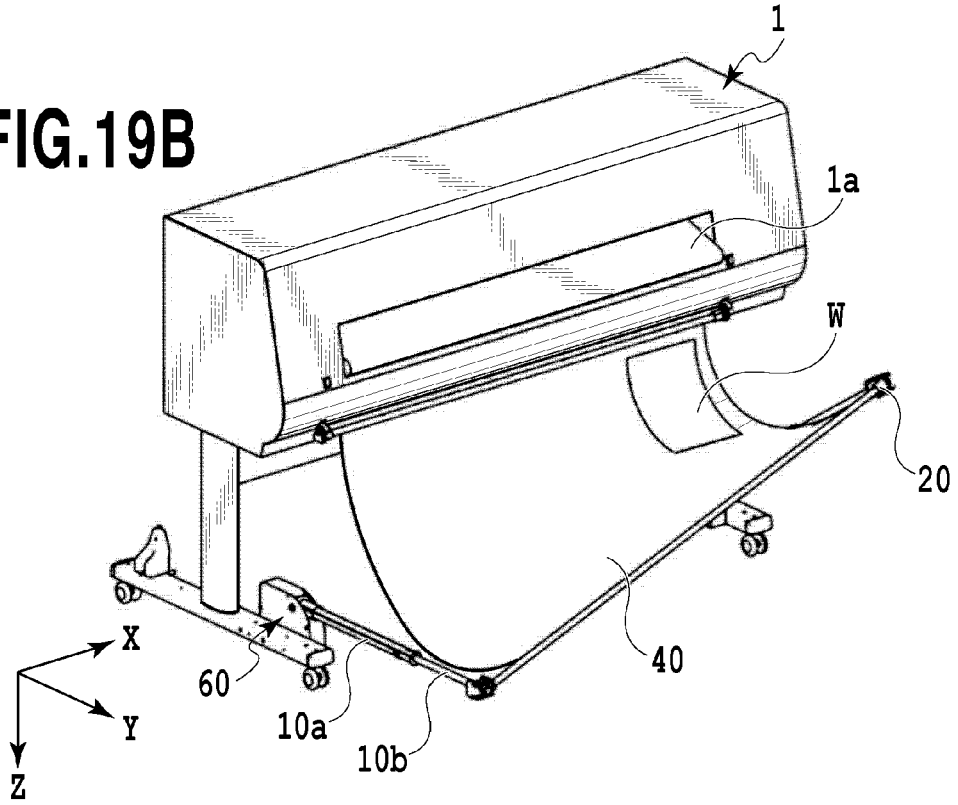

FIGS. 19A and 19B illustrate a position of the reception unit 3 in a case where the postures of the two side rods 10 are independently set, respectively. Similarly to the third front discharge position illustrated in FIG. 9A, FIG. 19A illustrates a state where the both side rods 10 are extended at the first angle. On the other hand, FIG. 19B illustrates a case where, in the third front discharge position, one side rod 10 is in an extension state at the first angle, and another side rod 10 is in an extension state at the second angle. For example, in the third front discharge position illustrated in FIG. 19A, after several print media W are discharged to the reception sheet 40, and in a case where the print mediums W are taken out, the print media W may be hardly taken out due to the front top rod 20. In such a case, in a case where only the side rod 10 on one side is changed from the first angle to the second angle, the inside of the reception sheet 40 is widely opened and thus, the user can easily take out printed items, as illustrated in FIG. 19B.

In a case where the side rod 10 is moved from the first angle to the second angle, the top rod 20 is gradually inclined with respect to the X axis, and a distance between the two joint portions 12 located at the leading ends of the side rod 10 is gradually increased. However, meanwhile, since the projecting portion 21*a* of the first engagement unit can gradually rotate or move in the long hole portion 12*a* of the joint portion 12, the position can be changed into that illustrated in FIG. 19B while the engagement of the two is maintained.

Furthermore, as described above, in a case where the discharged print medium is taken out from the reception sheet, there has been described the configuration of shifting to the posture illustrated in FIG. 19B. However, in a case where the comparatively small print medium is continuously discharged, the position of the reception unit 3 illustrated in FIG. 19B may be adopted from a stage of a printing operation. In this case, even during continuous printing, the discharged print medium can be appropriately discharged from the reception sheet 40.

Subsequently, an example in which the reception sheet 40 has a ridge-like shape will be described. According to the present specification, the ridge-like shape means partial expansion in a convex shape like a ridge (mountain ridge line) linearly extending in the discharge direction (Y direction) of the print medium. Irregularities are intentionally provided in the flexible reception sheet 40 so as to form the ridge-like shape. In a case where such a ridge-like shape is formed in the reception sheet 40, even if the print medium has low stiffness and easily follows a shape of the reception sheet 40, a contact area with the reception sheet 40 is reduced to be as small as possible, and sliding resistance between the print medium and the reception sheet 40 is suppressed, and the reception sheet 40 is able to guide the print medium to a target direction. Note that, in order to clearly form such a ridge-like shape, namely, a shape having at lease a projection and a recess, a material of the reception sheet 40 is preferably a soft and elastic fiber such as polyester.

Figure 20:
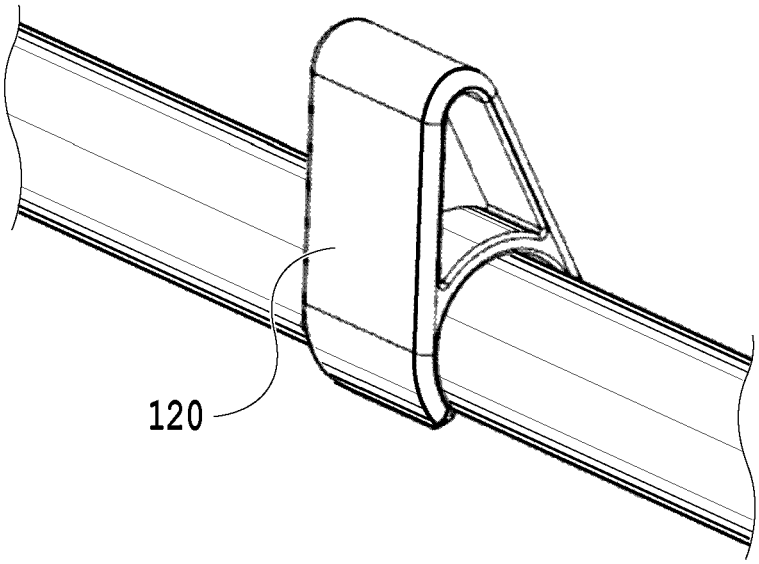
FIG. 20 illustrates a projecting portion to be attached to a rear rod.
Figure 21A:
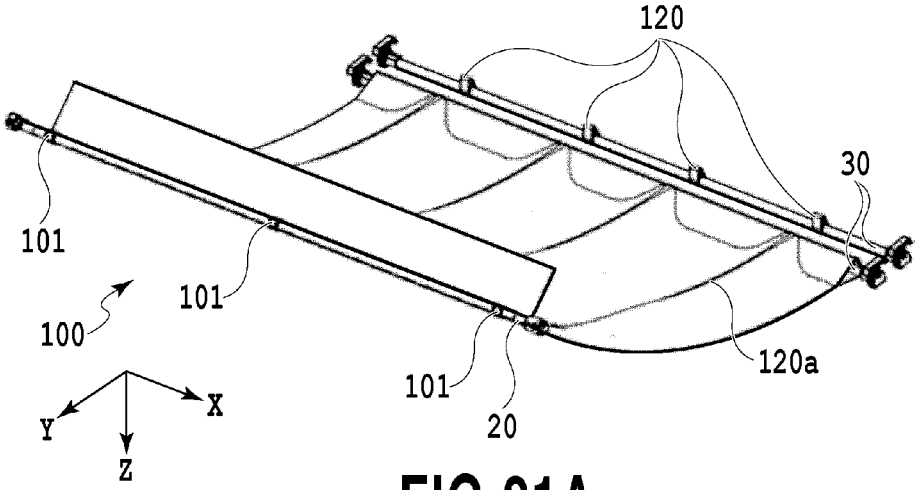
FIGS. 21A and 21B illustrate a reception region in a case where the projecting portion is attached to the rear rod.
Figure 21B:
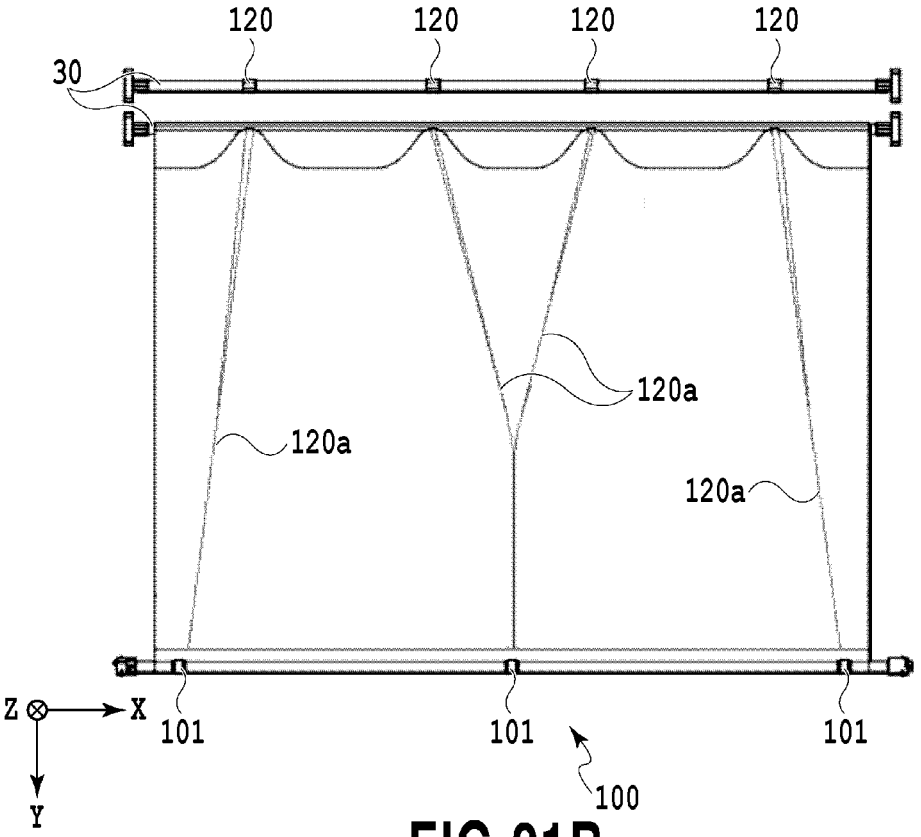

FIG. 20 illustrates a projecting portion 120 to be attached to the rear rod 30 in order to form the ridge-like shape. Furthermore, FIGS. 21A and 21B are a perspective view and a top plan view, respectively, illustrating the reception region in a case where four projecting portions 120 are attached to the rear rod 30 at equal intervals.

The reception sheet 40 has the convex shape formed at four positions where the projecting portions 120 are attached to a rear rod 30 side, and is fixed at three positions where the fixing members 101 are attached on a top rod 20 side. With this arrangement, the reception sheet is fixed and supported on lines connecting the projecting portion 120 and the fixing member 101. In other regions, the reception sheet 40 hangs down in the Z direction due to its own weight. As a result, as illustrated in FIG. 21B, there is formed the ridge-like shape 120*a* that extends in a direction crossing the direction of the discharge of the print medium. Therefore, even in a case where the print medium is discharged from the rear rod 30 side, or in a case where the print medium is discharged from the top rod 20 side, the surface of the discharged print medium is supported on the lines of the ridge-like shape 120*a*, whereby the print medium is prompted to proceed in the Y direction in a state where the sliding resistance is suppressed.

Figure 22A:
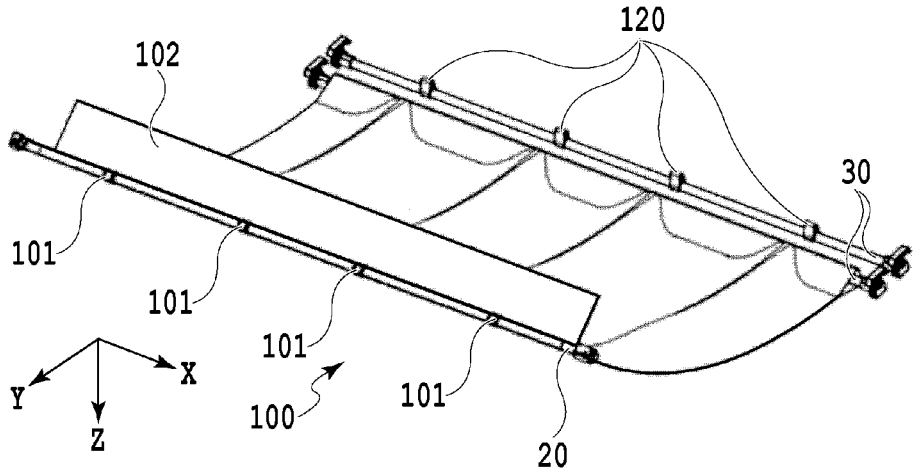
FIGS. 22A and 22B illustrate a reception region in a case where the projecting portion and a fixing member are attached corresponding to each other.
Figure 22B:
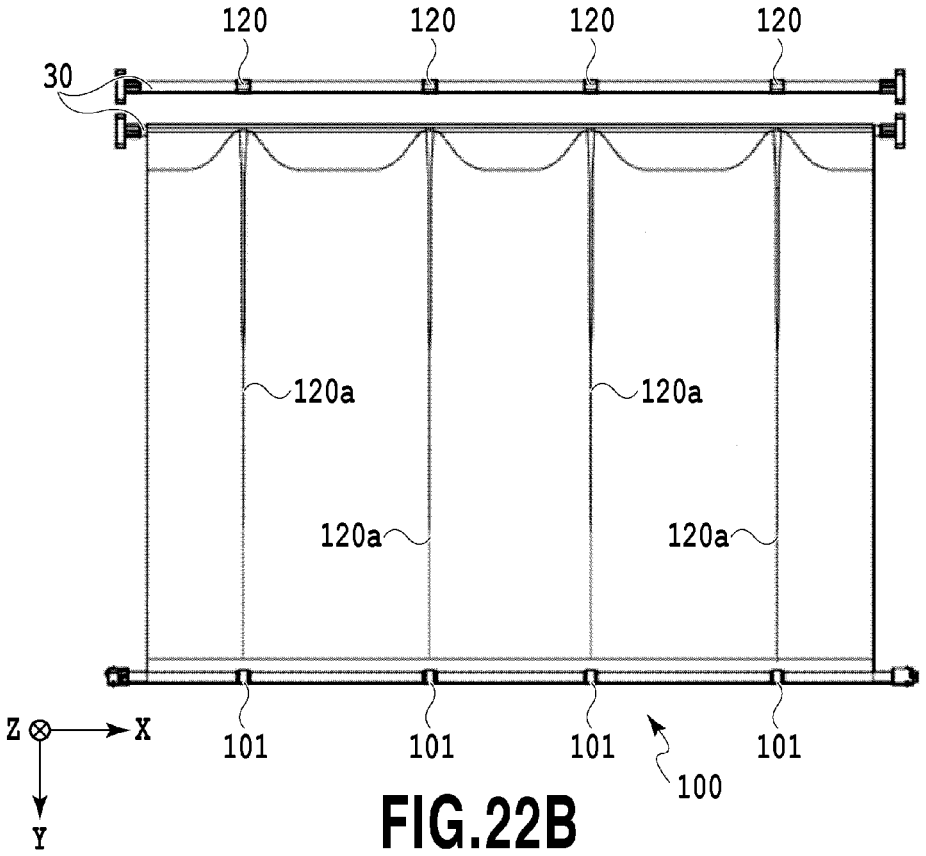

FIGS. 22A and 22B are a perspective view and a top plan view in a case where four projecting portions 120 are attached to the rear rod 30 at equal intervals, and the fixing members 101 facing each projecting portion 120 of the rear rod 30 are attached to four points, on the top rod 20 side. In the case of this configuration also, similarly to the case of FIGS. 21A and 21B, the region except for the ridge-like shape 120*a* hangs down in the Z direction due to own weight of the reception sheet 40. As a result, as illustrated in FIG. 22B, in the reception sheet 40, four ridge-like shapes 120*a* are formed substantially in parallel to one another toward the fixing member 101 from the projecting portion 120. In addition, in this configuration, the surface of the discharged print medium is supported on the lines of the ridge-like shape 120*a* extending in the Y direction, and is prompted to proceed in the Y direction in a state where the sliding resistance is suppressed.

Figure 23:
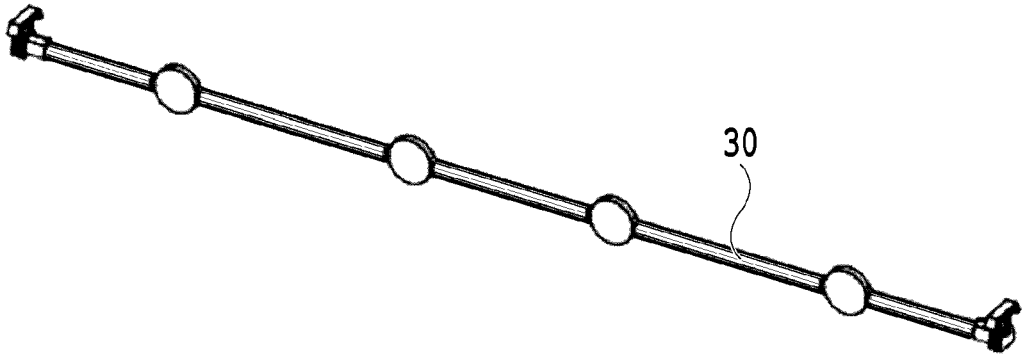
FIG. 23 illustrates a rear rod having a plurality of projecting shapes integrally formed.

Note that the number and a size of the projecting portion 120 are not particularly limited, and may be adjusted depending on the material of the reception sheet and the ridge-like shape required to be formed. Furthermore, as illustrated in FIG. 23, the rear rod 30 having a plurality of projecting shapes integrally formed may be adopted.

Figure 24A:
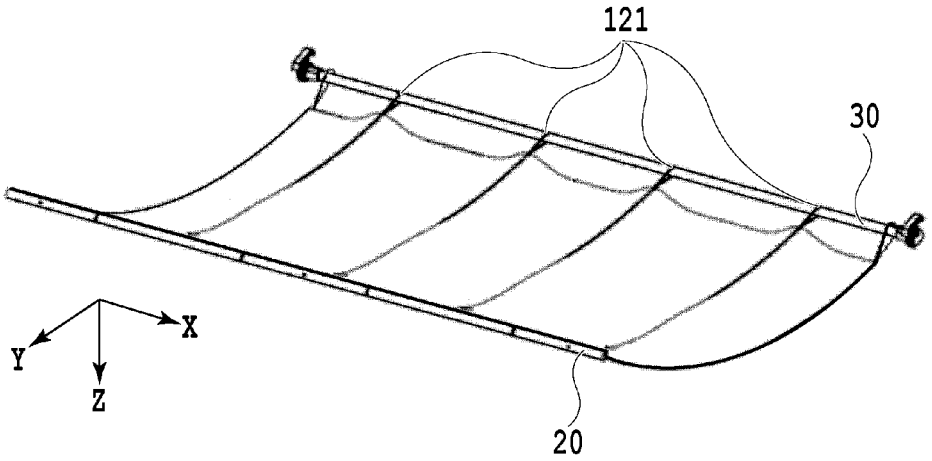
FIGS. 24A and 24B illustrate an example in which loop-shaped strings are provided to form ridge shapes.
Figure 24B:
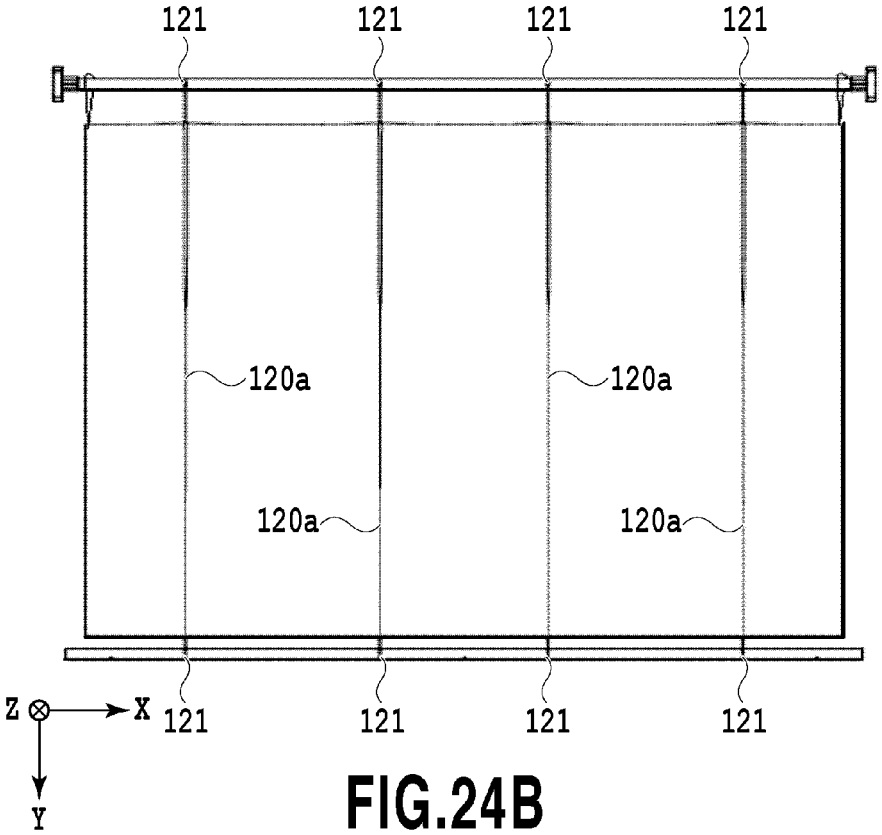

FIGS. 24A and 24B illustrate an example in which the ridge-like shape is formed by providing loop-shaped strings. In this example, at both end portions of the reception sheet 40 in the Y direction, loop strings 121 are previously sewed at predetermined intervals in the X direction, and the top rod 20 and the rear rod 30 are in a state of being passed through loops of the loop strings 121, respectively. FIGS. 24A and 24B illustrate a case where an attachment position of the loop string 121 on the top rod 20 side and an attachment position of the loop string 121 on the rear rod 30 side coincide with each other in the X direction. As a result, the reception sheet 40 has the ridge-like shapes 120*a* formed extending substantially in parallel to one another in the Y direction, and substantially the same effects as those in FIGS. 22A and 22B can be obtained.

Such a ridge-like shape can effectively function also in a case where, as illustrated in FIGS. 14A to 14C, for example, the reception length is reduced by winding up the reception sheet 40, so that the flat and smooth reception region is formed between top rod 20 and rear rod 30. In this case, a tension force is generated between the projecting portion 120 and the fixing member 101, and the ridge-like shape 120*a* is linearly formed along an orientation of the tension force. In addition, the contact area and the sliding resistance of the print medium with respect to the reception sheet 40 are further suppressed to be low and the print medium is linearly guided along the ridge-like shape 120*a*. As a result, as illustrated in FIGS. 14A to 14C, in a case where the flat and smooth reception region having the rising gradient is adopted, the print medium can be guided in a desired direction.

Note that the example of the embodiments receiving the print medium on which print processing is performed using the printer have been described above, but the present invention is not limited to the embodiments described above, and can also be widely applied to embodiments receiving articles discharged from a processing apparatus performing processing other than printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-191223, filed Sep. 29, 2015, No. 2015-19127, filed Sep. 29, 2015, and No. 2015-191317, filed Sep. 29, 2015, which are hereby incorporated by reference herein in their entireties.

What is claimed is:

1. An apparatus comprising:

a processing unit having a discharge port; and a reception unit that receives an article discharged from the discharge port, the apparatus reception unit comprising:

a first rod being disposed horizontally at a position below the discharge port in a gravity direction;

a second rod being disposed horizontally at a position farther away from the processing unit than the first rod; and a reception sheet having flexibility, supported by the first rod and the second rod, and configured to receive thereon the article discharged from the discharge port, wherein the first rod is capable of being disposed in at least one of a first position and a second position which are different from each other in the gravity direction and each provided on the processing unit, and wherein the first rod has hooks at both ends, and the processing unit has first engagement holes in which the hooks are engaged in a case where the first rod is disposed at the first position, and has second engagement holes, arranged lower than the first engagement holes in the gravity direction, in which the hooks are engaged in a case where the first rod is disposed at the second position.

2. The apparatus according to claim 1, wherein the processing unit has an exterior surface on which the first engagement holes and the second engagement holes are provided.

3. The apparatus according to claim 2, further comprising:

a leg unit that supports a bottom of the processing unit, and movable side rods that are supported by the leg unit and that support the second rod.

4. The apparatus according to claim 1, wherein the first rod is capable of being disposed at a third position, the third position being a position lower than the processing unit in the gravity direction and a position upstream of the processing unit in a direction in which the discharge port discharges the article.

5. The apparatus according to claim 1, wherein the second rod is capable of being disposed at a plurality of different positions.

6. The apparatus according to claim 5, wherein the second rod is disposed at the plurality of different positions by at least one of (i) rotating and (ii) extending and contracting of a support member that is arranged on the processing unit and supports both ends of the second rod.

7. The apparatus according to claim 1, further comprising an adjustment unit configured to change and fix a reception length of the reception sheet arranged between the first rod and the second rod.

8. The apparatus according to claim 1, wherein the reception sheet becomes a planar shape having a rising gradient in a direction of the discharge in a state where the article is not received, and becomes a curved shape curving in a gravity direction in a state where the article is received.

9. The apparatus according to claim 1, wherein the processing unit is a printer, and the article is a printed print medium.

10. An apparatus comprising:

a processing unit having a discharge port; and a reception unit that receives an article discharged from the discharge port, the reception unit comprising:

a first rod being disposed horizontally at a position below the discharge port in a gravity direction;

a second rod disposed horizontally at a position farther away from the processing unit than the first rod;

a reception sheet having flexibility, supported by the first rod and the second rod, and configured to receive thereon the article discharged from the discharge port;

an adjustment unit configured to change and fix a reception length of the reception sheet arranged between the first rod and the second rod; and a release unit configured to release fixing of the reception length by the adjustment unit.

11. The apparatus according to claim 10, wherein the adjustment unit winds up the reception sheet on at least one of the first rod and the second rod to thereby adjust the reception length; and the adjustment unit prevents the first rod or the second rod having wound up the reception sheet from rotating in a direction opposite to a direction of the winding to thereby fix the reception length.

12. The reception apparatus according to claim 11 wherein the release unit has a release button that unlocks the adjustment unit to allow rotating of the first rod or the second rod in the direction opposite to the direction of the winding.

13. The apparatus according to claim 10, wherein the processing unit is a printer, and the article is a printed print medium.

14. A printing apparatus comprising:

a printing unit configured to print an image on a sheet;

a discharge unit configured to discharge the sheet on which the image is printed by the printing unit;

a reception sheet configured to receive the sheet discharged from the discharge unit;

a first rod extending in a width direction of the sheet and configured to support the reception sheet;

a second rod extending in the width direction of the sheet and configured to support the reception sheet together with the first rod;

a first supporting unit configured to support the second rod at a first height in a gravity direction;

a second supporting unit configured to support the first rod at a second height, the second height being higher than the first height in the gravity direction; and a third supporting unit configured to support the first rod at a third height, the third height being lower than the first height in the gravity direction.

15. The printing apparatus according to claim 14, wherein, in a case where the first rod is supported by the second supporting unit and the second rod is supported at the first height, a print surface on which the image is printed by the printing unit does not face the reception sheet, and wherein, in a case where the first rod is supported by the third supporting unit and the second rod is supported at the first height, the print surface on which the image is printed by the printing unit faces the reception sheet.

16. The printing apparatus according to claim 14, further comprising a forth supporting unit configured to support the first rod at a fourth height, the fourth height being lower than the third height in the gravity direction.

17. The printing apparatus according to claim 14, wherein the first supporting unit can support the second rod at a fifth height, the fifth height being lower than the first height in the gravity direction.

18. The printing apparatus according to claim 14, further comprising a changing unit configured to change a length of the reception sheet between the first rod and the second rod when the first rod is supported by the second supporting unit and the second rod is supported by the first supporting unit.

19. The printing apparatus according to claim 18, further comprising a fixing unit configured to fix the length of the reception sheet.

20. The printing apparatus according to claim 19, further comprising a release unit configured to release fixing of the length of the reception sheet by the fixing unit.

21. The printing apparatus according to claim 14, further comprising a cutter unit configured to cut the sheet on which the image is printed by the printing unit.

22. The printing apparatus according to claim 14, wherein the sheet on which the image is printed is a roll sheet held in a rolled shape.

23. The printing apparatus according to claim 14, further comprising:

a sensor configured to detect whether or not a sheet is on the reception sheet; and a positioning unit configured to position the second rod in the gravity direction, wherein, in a case where the sensor detects a sheet, the positioning unit positions the second rod at the first height, and wherein, in a case where the sensor does not detect a sheet, the positioning unit positions the second rod at a height lower than the first height.

24. The printing apparatus according to claim 14, wherein the reception sheet has a partial expansion in a convex shape linearly extending in a discharge direction of the sheet.

25. The printing apparatus according to claim 14, wherein the reception sheet is one of a cloth sheet, a plastic sheet, or a metal sheet.

* * * * *